US011132928B2

(12) United States Patent
Jin et al.

(10) Patent No.: US 11,132,928 B2
(45) Date of Patent: Sep. 28, 2021

(54) HORIZONTAL LINE DRIVER AND DISPLAY DEVICE INCLUDING THE SAME

(71) Applicant: SAMSUNG DISPLAY CO., LTD., Yongin-si (KR)

(72) Inventors: Ja-Kyoung Jin, Hwaseong-si (KR); Tae-Jin Kim, Hwaseong-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/253,524

(22) PCT Filed: Jun. 11, 2019

(86) PCT No.: PCT/KR2019/006984
§ 371 (c)(1),
(2) Date: Dec. 17, 2020

(87) PCT Pub. No.: WO2019/245211
PCT Pub. Date: Dec. 26, 2019

(65) Prior Publication Data

US 2021/0134206 A1 May 6, 2021

(30) Foreign Application Priority Data

Jun. 18, 2018 (KR) ..... 10-2018-0069756

(51) Int. Cl.
*G09G 3/20* (2006.01)

(52) U.S. Cl.
CPC ..... *G09G 3/20* (2013.01); *G09G 2310/0278* (2013.01); *G09G 2310/0291* (2013.01)

(58) Field of Classification Search
CPC ..... G09G 3/20; G09G 2310/0278; G09G 2310/0291
See application file for complete search history.

(56) References Cited

U.S. PATENT DOCUMENTS

2019/0073075 A1* 3/2019 Cho ..... G09G 3/3674
2019/0073085 A1* 3/2019 Zhang ..... G06F 3/0412
2019/0073746 A1* 3/2019 Greene ..... G06F 13/12

FOREIGN PATENT DOCUMENTS

JP 2009-069768 4/2009
KR 10-0599470 7/2006
(Continued)

OTHER PUBLICATIONS

International Search Report issued in corresponding application No. PCT/KR2019/006984 dated Sep. 16, 2019.

*Primary Examiner* — Sejoon Ahn
(74) *Attorney, Agent, or Firm* — F. Chau & Associates, LLC

(57) ABSTRACT

A horizontal line driver providing a scan signal to scan lines, and including: first scan signal output blocks providing the scan signal to scan lines in a first side display area, wherein each of the first scan signal output blocks include a first output buffer; second scan signal output blocks providing the scan signal to scan lines in a first front display area including curved edges, wherein each of the second scan signal output blocks include a second output buffer; and third scan signal output blocks providing the scan signal to scan lines in a second front display area. Each of the third scan signal output blocks include a third output buffer. The width of the first front display area is larger than a width of the first side display area but is smaller than a width of the second front display area, and the width gradually increases.

20 Claims, 11 Drawing Sheets

(56) References Cited

FOREIGN PATENT DOCUMENTS

| | | |
|---|---|---|
| KR | 10-0721944 | 5/2007 |
| KR | 10-2017-0053211 | 5/2017 |
| KR | 10-2017-0092726 | 8/2017 |
| KR | 10-2018-0049005 | 5/2018 |
| KR | 10-2018-0050372 | 5/2018 |
| KR | 10-2018-0057816 | 5/2018 |
| KR | 10-2019-0041046 | 4/2019 |

* cited by examiner

HORIZONTAL LINE DRIVER AND DISPLAY DEVICE INCLUDING THE SAME

CROSS-REFERENCE TO RELATED APPLICATIONS

This application is a national stage entry of International Application Number PCT/KR2019/006984, filed on Jun. 11, 2019, which claims priority to Korean Patent Application No. 10-2018-0069756, filed on Jun. 18, 2018, the disclosures of which are incorporated by reference herein in their entireties.

TECHNICAL FIELD

Exemplary Embodiments of the present inventive concept relate generally to a display device. More particularly, exemplary embodiments of the present inventive concept relate to a horizontal line driver that provides a horizontal signal to a display panel, and a display device including the horizontal line driver.

DISCUSSION OF THE RELATED ART

In general, an electronic device (e.g., a smart phone, a smart, pad, etc.) includes, for example, a display device for providing visual information to a user. For example, the display device may include a display panel, a scan driver, a data driver, and a time controller. For example, the display panel includes pixel circuits, and the scan driver is configured to provide a scan signal to the display panel. The data driver is configured to provide a data signal to the display panel, and a timing controller is configured to control the scan driver and the data driver. In addition, when the display device is an organic light emitting diode display device, the display device typically includes an emission driver configured to provide an emission signal to the display panel, and the like. In this case, the scan signal may be provided to the display panel through a scan line extending in a first direction, and the emission signal may be provided to the display panel through an emission line extending in the first direction (e.g., a horizontal direction).

Recently, to provide an aesthetic appearance for an electronic device and increase the convenience in use of the electronic device, many manufacturers are developing a display panel of a display device to include a front surface display area and side surface display areas. In addition, to make the appearance of the electronic device more attractive, many manufacturers are designing the display panel such that edges of the front surface display area of the display panel have a curved shape. In this case, when the side surface display area includes a first side surface display area located on an upper side of the display panel in a second direction (e.g., a vertical direction) and a second side surface display area located on a lower side of the display panel in the second direction, the front surface display area may include a first front surface display area, which includes curved edges in the second direction, and a second front surface display area, which does not include the curved edges in the second direction.

Accordingly, a width of each of the first and second side surface display areas in the first direction, a width of the first front surface display area in the first direction, and a width of the second front surface display area in the first direction are different from each other, so that a length of each of horizontal lines (e.g., scan lines or emission lines) in the first and second side surface display areas, a length of each of horizontal lines in the first front surface display area, and a length of each of horizontal lines in the second front surface display area are different from each other. Therefore, an RC delay of each of the first and second side surface display areas, an RC delay of the first front surface display area, and an RC delay of the second front surface display area may also be different from each other. As a result, even if the same data signal is applied to the first and second side surface display areas, the first front surface display area, and the second front surface display area, non-uniformity luminance may be caused by the difference in the RC delays among the first and second side surface display areas, the first front surface display area, and the second front surface display area.

SUMMARY

According to an exemplary embodiment of the present inventive concept, a horizontal line driver is configured to provide a scan signal to a display panel including a plurality of pixel circuits respectively connected to scan lines extending in a first direction, and the horizontal line driver includes: first to $j^{th}$ scan signal output blocks configured to respectively provide the scan signal to first to $j^{th}$ scan lines disposed in a first side surface display area located on a first side of the display panel extending in the first direction, wherein the first to $j^{th}$ scan signal output blocks are disposed on a second side of the display panel extending in a second direction substantially perpendicular to the first direction, wherein each of the first to $j^{th}$ scan signal output blocks include a first output buffer, and wherein j is an integer greater than 1; $(j+1)^{th}$ to $k^{th}$ scan signal output blocks configured to respectively provide the scan signal to $(j+1)^{th}$ to $k^{th}$ scan lines disposed in a first front surface display area including curved edges extending in the second direction, wherein the $(j+1)^{th}$ to $k^{th}$ scan signal output blocks are disposed on the second side of the display panel, wherein each of the $(j+1)^{th}$ to $k^{th}$ scan signal output blocks include a second output buffer, and wherein k is an integer greater than j+1; and $(k+1)^{th}$ to $m^{th}$ scan signal output blocks configured to respectively provide the scan signal to $(k+1)^{th}$ to $m^{th}$ scan lines disposed in a second front surface display area, wherein the $(k+1)^{th}$ to $m^{th}$ scan signal output blocks are disposed on the second side of the display panel, wherein each of the $(k+1)^{th}$ to $m^{th}$ scan signal output blocks include a third output buffer, and wherein m is an integer greater than k+1. A width of the first side surface display area in the first direction is smaller than a width of the first front surface display area in the first direction, wherein the width of the first front surface display area is smaller than a width of the second front surface display area in the first direction, and wherein the width of the first front surface display area gradually increases toward the second front surface display area.

In an exemplary embodiment of the present inventive concept, a length of each of the first to $j^{th}$ scan lines is shorter than a length of each of the $(j+1)^{th}$ to $k^{th}$ scan lines, wherein the length of each of the $(j+1)^{th}$ to $k^{th}$ scan lines is shorter than a length of each of the $(k+1)^{th}$ to $m^{th}$ scan lines, and wherein the length of each of the $(j+1)^{th}$ to $k^{th}$ scan lines gradually increases toward the second front surface display area.

In an exemplary embodiment of the present inventive concept, a size of the first output buffer is smaller than a size of the second output buffer, wherein the size of the second output buffer is smaller than a size of the third output buffer, and wherein the size of the second output buffer gradually increases toward the second front surface display area.

In an exemplary embodiment of the present inventive concept, the horizontal line driver further includes: $(m+1)^{th}$ to $n^{th}$ scan signal output blocks configured to respectively provide the scan signal to $(m+1)^{th}$ to $n^{th}$ scan lines disposed in the first front surface display area, wherein $(m+1)^{th}$ to $n^{th}$ scan signal output blocks are disposed on the second side of the display panel, wherein each of the $(m+1)^{th}$ to $n^{th}$ scan signal output blocks include the second output buffer, and wherein n is an integer greater than m+1; and $(n+1)^{th}$ to $p^{th}$ scan signal output blocks configured to respectively provide the scan signal to $(n+1)^{th}$ to $p^{th}$ scan lines disposed in a second side surface display area located on a third side of the display panel extending in the first direction, wherein the $(n+1)^{th}$ to $p^{th}$ scan signal output blocks are disposed on the second side of the display panel, wherein each of the $(n+1)^{th}$ to $p^{th}$ scan signal output blocks include the first output buffer, and wherein p is an integer greater than n+1. A width of the second side surface display area in the first direction is smaller than the width of the first front surface display area in the first direction.

In an exemplary embodiment of the present inventive concept, a length of each of the $(n+1)^{th}$ to $p^{th}$ scan lines is shorter than a length of each of the $(m+1)^{th}$ to $n^{th}$ scan lines, wherein the length of each of the $(m+1)^{th}$ to $n^{th}$ scan lines is shorter than a length of each of the $(k+1)^{th}$ to $m^{th}$ scan lines, and wherein the length of each of the $(m+1)^{th}$ to $n^{th}$ scan lines gradually increases toward the second front surface display area.

In an exemplary embodiment of the present inventive concept, a size of the first output buffer is smaller than a size of the second output buffer, wherein the size of the second output buffer is smaller than a size of the third output buffer, and wherein the size of the second output buffer gradually increases toward the second front surface display area.

According to an exemplary embodiment of the present inventive concept, a horizontal line driver is configured to provide an emission signal to a display panel including a plurality of pixel circuits respectively connected to emission lines extending in a first direction, and the horizontal line driver includes: first to $j^{th}$ emission signal output, blocks configured to respectively provide the emission signal to first to $j^{th}$ emission lines disposed in a first side surface display area located on a first side of the display panel extending in the first direction, wherein the first to $j^{th}$ emission signal output blocks are disposed on a second side of the display panel extending in a second direction substantially perpendicular to the first, direction, wherein each of the first to $j^{th}$ emission signal output blocks include a first output buffer, and wherein j is an integer greater than 1; $(j+1)^{th}$ to $k^{th}$ emission signal output blocks configured to respectively provide the emission signal to $(j+1)^{th}$ to $k^{th}$ emission lines disposed in a first front surface display area including curved edges in the second direction, wherein the $(j+1)^{th}$ to $k^{th}$ emission signal output blocks are disposed on the second side of the display panel, wherein each of the $(j+1)^{th}$ to $k^{th}$ emission signal output blocks include a second output buffer, and wherein k is an integer greater than j+1; and $(k+1)^{th}$ to $m^{th}$ emission signal output blocks configured to respectively provide the emission signal to $(k+1)^{th}$ to $m^{th}$ emission lines disposed in a second front surface display area that does not include curved edges extending in the second direction, wherein the $(k+1)^{th}$ to $m^{th}$ emission signal output blocks are disposed on the second side of the display panel, wherein each of the $(k+1)^{th}$ to $m^{th}$ emission signal output blocks include a third output buffer, and wherein m is an integer greater than k+1. A width of the first side surface display area in the first direction is smaller than a width of the first front surface display area in the first direction, wherein the width of the first front surface display area is smaller than a width of the second front surface display area in the first direction, and wherein the width of the first front surface display area gradually increases toward the second front surface display area.

In an exemplary embodiment of the present inventive concept, a length of each of the first to $j^{th}$ emission lines is shorter than a length of each of the $(j+1)^{th}$ to $k^{th}$ emission lines, wherein the length of each of the $(j+1)^{th}$ to $k^{th}$ emission lines is shorter than a length of each of the $(k+1)^{th}$ to $m^{th}$ emission lines, and wherein the length of each of the $(j+1)^{th}$ to $k^{th}$ emission lines gradually increases toward the second front surface display area.

In an exemplary embodiment of the present inventive concept, a size of the first output buffer is smaller than a size of the second output buffer, wherein the size of the second output buffer is smaller than a size of the third output buffer, and wherein the size of the second output buffer gradually increases toward the second front surface display area.

In an exemplary embodiment of the present inventive concept, the horizontal line driver further includes: $(m+1)^{th}$ to $n^{th}$ emission signal output blocks configured to respectively provide the emission signal to $(m+1)^{th}$ to $n^{th}$ emission lines disposed in the first front surface display area, wherein the $(m+1)^{th}$ to $n^{th}$ emission signal output blocks are disposed on the second side of the display panel, wherein each of the $(m+1)^{th}$ to $n^{th}$ emission signal output blocks include the second output buffer, and wherein n is an integer greater than m+1; and $(n+1)^{th}$ to $p^{th}$ emission signal output blocks configured to respectively provide the emission signal to $(n+1)^{th}$ to $p^{th}$ emission lines disposed in a second side surface display area located on a third side of the display panel extending in the first direction, wherein the $(n+1)^{th}$ to $p^{th}$ emission signal output blocks are disposed on the second side of the display panel, wherein each of the $(n+1)^{th}$ to $p^{th}$ emission signal output blocks include the first output buffer, and wherein p is an integer greater than n+1. A width of the second side surface display area in the first direction is smaller than the width of the first front surface display area in the first direction.

In an exemplary embodiment of the present inventive concept, a length of each of the $(n+1)^{th}$ to $p^{th}$ emission lines is shorter than a length of each of the $(m+1)^{th}$ to $n^{th}$ emission lines, wherein the length of each of the $(m+1)^{th}$ to $n^{th}$ emission lines is shorter than a length of each of the $(k+1)^{th}$ to $m^{th}$ emission lines, and wherein the length of each of the $(m+1)^{th}$ to $n^{th}$ emission lines gradually increases toward the second front surface display area.

In an exemplary embodiment of the present inventive concept, a size of the first output buffer is smaller than a size of the second output buffer, wherein the size of the second output buffer is smaller than a size of the third output buffer, and wherein the size of the second output buffer gradually increases toward the second front surface display area.

According to an exemplary embodiment of the present inventive concept, a display device includes: a display panel including a plurality of pixel circuits; a scan driver configured to provide a scan signal to the display panel through scan lines extending in a first direction; a data driver configured to provide a data signal to the display panel through data lines extending in a second direction substantially perpendicular to the first direction; and a timing controller configured to control the scan driver and the data driver, wherein the scan driver includes: first to $j^{th}$ scan signal output blocks configured to respectively provide the scan signal to first to $j^{th}$ scan lines disposed in a first side surface display area located on an upper side of the display panel extending in the first direction, wherein the first to $j^{th}$ scan signal output blocks are disposed on a first side of the display panel extending in the second direction, wherein each of the first to $j^{th}$ scan signal output blocks include a first output buffer, and wherein j is an integer greater than 1; $(j+1)^{th}$ to $k^{th}$ scan signal output blocks configured to respectively provide the scan signal to $(j+1)^{th}$ to $k^{th}$ scan lines disposed in a first front surface display area including curved edges extending in the second direction, wherein $(j+1)^{th}$ to $k^{th}$ scan signal output blocks are disposed on the first side of the display panel, wherein each of the $(j+1)^{th}$ to $k^{th}$ scan signal output blocks include a second output buffer, and wherein k is an integer greater than j+1; $(k+1)^{th}$ to $m^{th}$ scan signal output blocks configured to respectively provide the scan signal to $(k+1)^{th}$ to $m^{th}$ scan lines disposed in a second front surface display area that does not include curved edges extending in the second direction, wherein the $(k+1)^{th}$ to $m^{th}$ scan signal output blocks are disposed on the first side of the display panel, wherein each of the $(k+1)^{th}$ to $m^{th}$ scan signal output blocks include a third output buffer, and wherein m is an integer greater than k+1; $(m+1)^{th}$ to $n^{th}$ scan signal output blocks configured to respectively provide the scan signal to $(m+1)^{th}$ to $n^{th}$ scan lines disposed in the first front surface display area, wherein the $(m+1)^{th}$ to $n^{th}$ scan signal output blocks are disposed on the first side of the display panel, wherein each of the $(m+1)^{th}$ to $n^{th}$ scan signal output blocks include the second output buffer, and wherein n is an integer greater than m+1; and $(n+1)^{th}$ to $p^{th}$ scan signal output blocks configured to respectively provide the scan signal to $(n+1)^{th}$ to $p^{th}$ scan lines disposed in a second side surface display area located on a lower side of the display panel extending in the first direction, wherein $(n+1)^{th}$ to $p^{th}$ scan signal output blocks are disposed on the first side of the display panel, wherein each of the $(n+1)^{th}$ to $p^{th}$ scan signal output blocks include the first output buffer, and wherein p is an integer greater than n+1. Each of a width of the first side surface display area in the first direction and a width of the second side surface display area in the first direction is smaller than a width of the first front surface display area in the first direction, wherein the width of the first front surface display area is smaller than a width of the second front surface display area in the first direction, and wherein the width of the first front surface display area gradually increases toward the second front surface display area.

In an exemplary embodiment of the present inventive concept, a length of each of the first to $j^{th}$ scan lines is shorter than a length of each of the $(j+1)^{th}$ to $k^{th}$ scan lines, wherein the length of each of the $(j+1)^{th}$ to $k^{th}$ scan lines is shorter than a length of each of the $(k+1)^{th}$ to $m^{th}$ scan lines, and wherein the length of each of the $(j+1)^{th}$ to $k^{th}$ scan lines gradually increases toward the second front surface display area.

In an exemplary embodiment of the present inventive concept, a length of each of the $(n+1)^{th}$ to $p^{th}$ scan lines is shorter than a length of each of the $(m+1)^{th}$ to $n^{th}$ scan lines, wherein the length of each of the $(m+1)^{th}$ to $n^{th}$ scan lines is shorter than the length of each of the $(k+1)^{th}$ to $m^{th}$ scan lines, and wherein the length of each of the $(m+1)^{th}$ to $n^{th}$ scan lines gradually increases toward the second front surface display area.

In an exemplary embodiment of the present inventive concept, a size of the first output buffer is smaller than a size of the second output buffer, wherein the size of the second output buffer is smaller than a size of the third output buffer, and wherein the size of the second output buffer gradually increases toward the second front surface display area.

In an exemplary embodiment of the present inventive concept, the display device further includes: an emission driver configured to provide an emission signal to the display panel through emission lines extending in the first direction, wherein the timing controller is further configured to control the emission driver, and wherein the emission driver includes: first to $j^{th}$ emission signal output blocks configured to respectively provide the emission signal to first to $j^{th}$ emission lines disposed in the first side surface display area, wherein the first to $j^{th}$ emission signal output blocks are disposed on a second side of the display panel opposite to the first side of the display panel, and wherein each of the first to $j^{th}$ emission signal output blocks include a fourth output buffer; $(j+1)^{th}$ to $k^{th}$ emission signal output blocks configured to respectively provide the emission signal to $(j+1)^{th}$ to $k^{th}$ emission lines disposed in the first front surface display area, wherein the $(j+1)^{th}$ to $k^{th}$ emission signal output blocks are disposed on the second side of the display panel, and wherein each of the $(j+1)^{th}$ to $k^{th}$ emission signal output blocks include a fifth output buffer; $(k+1)^{th}$ to $m^{th}$ emission signal output blocks configured to respectively provide the emission signal to $(k+1)^{th}$ to $m^{th}$ emission lines disposed in the second front surface display area, wherein the $(k+1)^{th}$ to $m^{th}$ emission signal output blocks are disposed on the second side of the display panel, and wherein each of the $(k+1)^{th}$ to $m^{th}$ emission signal output blocks include a sixth output buffer; $(m+1)^{th}$ to $n^{th}$ emission signal output blocks configured to respectively provide the emission signal to $(m+1)^{th}$ to $n^{th}$ emission lines disposed in the first front surface display area, wherein the $(m+1)^{th}$ to $n^{th}$ emission signal output, blocks are disposed on the second side of the display panel, and wherein each of the $(m+1)^{th}$ to $n^{th}$ emission signal output blocks include the fifth output buffer; and $(n+1)^{th}$ to $p^{th}$ emission signal output blocks configured to respectively provide the emission signal to $(n+1)^{th}$ to $p^{th}$ emission lines disposed in the second side surface display area, wherein the $(n+1)^{th}$ to $p^{th}$ emission signal output blocks are disposed on the second side of the display panel, and each of the $(n+1)^{th}$ to $p^{th}$ emission signal output blocks include the fourth output buffer.

In an exemplary embodiment of the present inventive concept, a length of each of the first to $j^{th}$ emission lines is shorter than a length of each of the $(j+1)^{th}$ to $k^{th}$ emission lines, wherein the length of each of the $(j+1)^{th}$ to $k^{th}$ emission lines is shorter than a length of each of the $(k+1)^{th}$ to $m^{th}$ emission lines, and wherein the length of each of the $(j+1)^{th}$ to $k^{th}$ emission lines gradually increases toward the second front surface display area.

In an exemplary embodiment of the present inventive concept, a length of each of the $(n+1)^{th}$ to $p^{th}$ emission lines is shorter than a length of each of the $(m+1)^{th}$ to $n^{th}$ emission lines, wherein the length of each of the $(m+1)^{th}$ to $n^{th}$ emission lines is shorter than the length of each of the $(k+1)^{th}$ to $m^{th}$ emission lines, and wherein the length of each of the $(m+1)^{th}$ to $n^{th}$ emission lines gradually increases toward the second front surface display area.

In an exemplary embodiment of the present inventive concept, a size of the fourth output buffer is smaller than a size of the fifth output buffer, wherein the size of the fifth output buffer is smaller than a size of the sixth output buffer, and wherein the size of the fifth output buffer gradually increases toward the second front surface display area.

DETAILED DESCRIPTION OF THE EMBODIMENTS

Hereinafter, exemplary embodiments of the present inventive concept will be explained in detail with reference to the accompanying drawings.

Figure 1A:
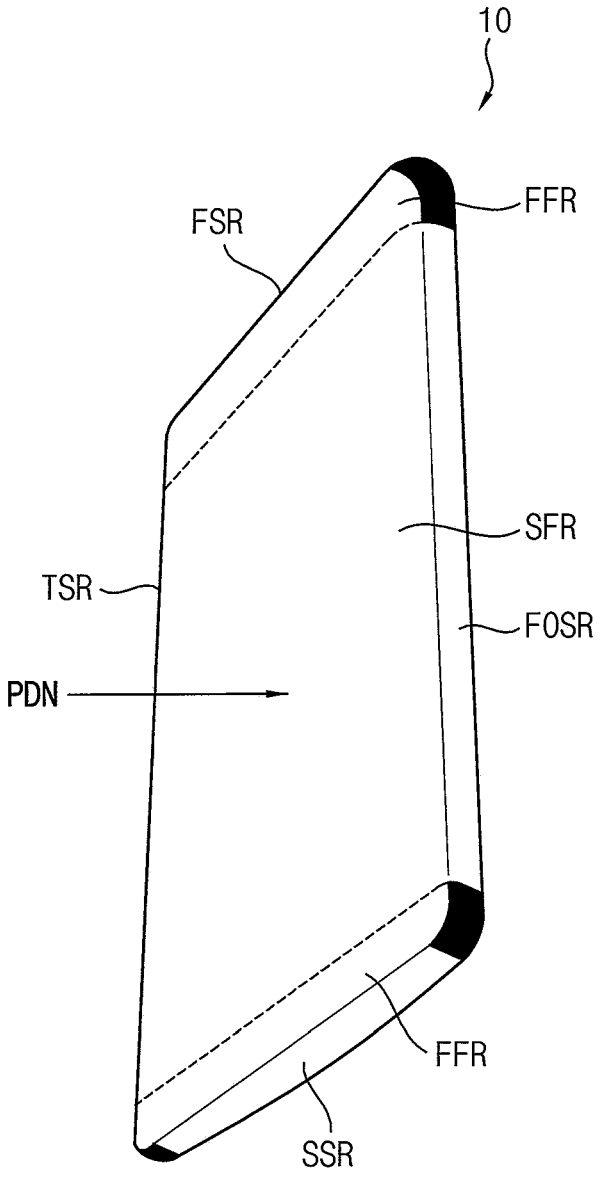
FIG. 1A is a diagram illustrating an electronic device according to an exemplary embodiment of the present inventive concept.
Figure 1B:
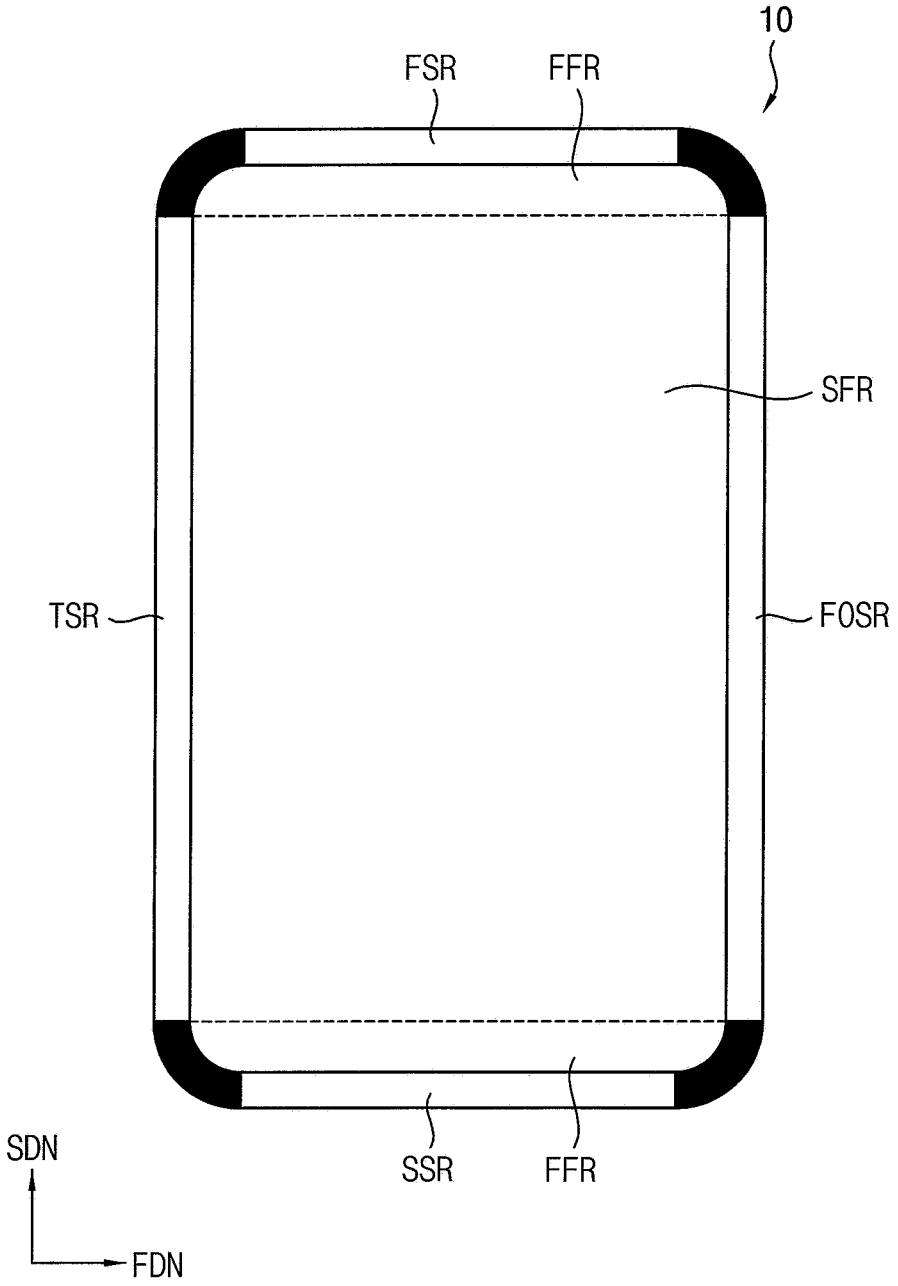
FIG. 1B is a plan view showing the electronic device of FIG. 1A viewed in a front direction.
Figure 2:
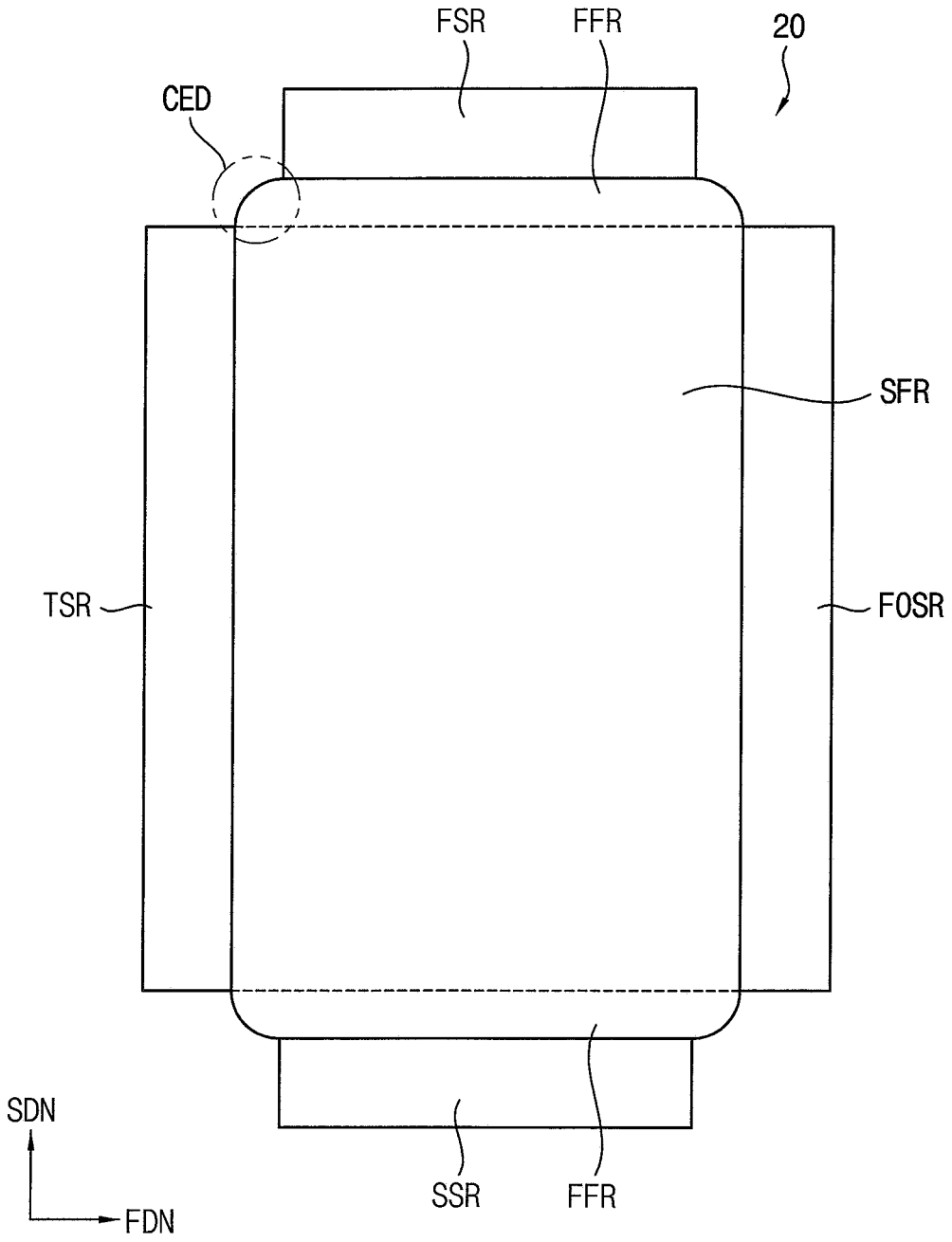
FIG. 2 is a diagram illustrating an example of a display panel included in the electronic device of FIG. 1A.
Figure 3:
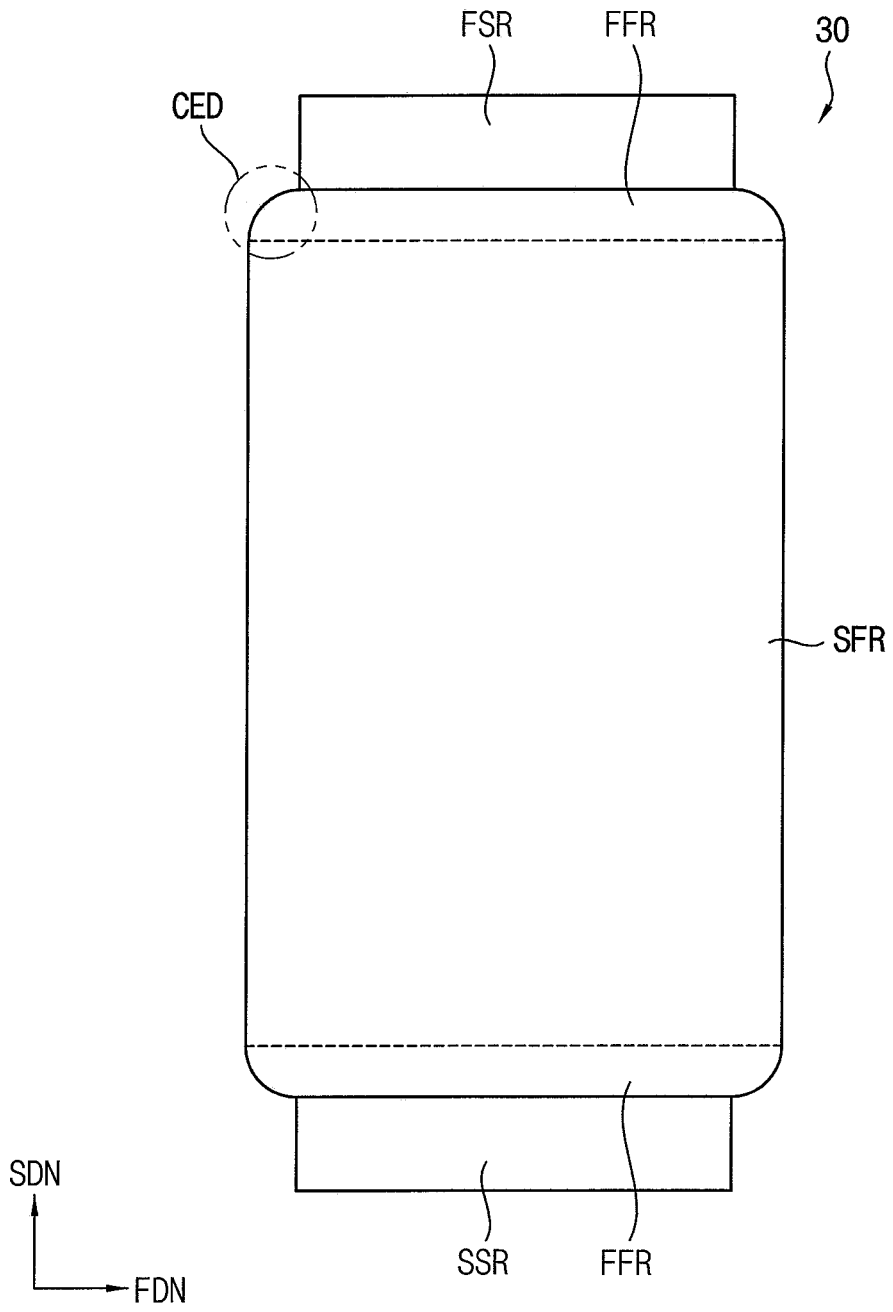
FIG. 3 is a diagram illustrating an example of a display panel included in the electronic device of FIG. 1A.

FIG. 1A is a diagram illustrating an electronic device according to an exemplary embodiment of the present inventive concept. FIG. 1B is a plan view showing the electronic device of FIG. 1A viewed in a front direction. FIG. 2 is a diagram illustrating an example of a display panel included in the electronic device of FIG. 1A, and FIG. 3 is a diagram illustrating an example of a display panel included in the electronic device of FIG. 1A.

Referring to FIGS. 1A to 3, an electronic device 10 may include a display device, and the display device may include a display panel with a polygonal shape (e.g., a display panel 20 or a display panel 30). According to an exemplary embodiment of the present inventive concept, the display device may further include a touch sensor panel that overlaps the polygonal display panel, or a touch sensor may be formed on the polygonal display panel. In this case, the display device may perform a touch sensing function as well as a display function.

As shown in FIG. 1A, the electronic device 10 may include a polygonal display panel divided into front surface display areas FFR and SFR and side surface display areas FSR, SSR, TSR, and FOSR. Accordingly, the electronic device 10 may have an aesthetic appearance that may appeal to a user, and may performs various display functions and/or touch sensing functions through the front surface display areas FFR and SFR and the side surface display areas FSR, SSR, TSR, and FOSR. For example, as shown in FIG. 1B, when the user views the electronic device 10 in a front direction FDN, the front surface display areas FFR and SFR may be recognized as flat surfaces substantially perpendicular to the front direction FDN, and the side surface display areas FSR, SSR, TSR, and FOSR may be recognized as slightly-curved or substantially flat surfaces that are inclined in the front direction FDN. However, the above configuration is described for illustrative purposes, and the present inventive concept is not limited thereto. According to an exemplary embodiment of the present inventive concept, the side surface display areas FSR, SSR, TSR, and FOSR may be folded to be flat surfaces parallel to the front direction FDN, so that the side surface display areas FSR, SSR, TSR, and FOSR may not be recognized or viewed in the front direction FDN.

As described above, the polygonal display panel included in the electronic device 10 may be divided into the front surface display areas FFR and SFR and the side surface display areas FSR, SSR, TSR, and FOSR. In this case, the polygonal display panel may include a plurality of pixel circuits connected to horizontal lines (e.g., scan lines or emission lines) extending in the first direction FDN. In this case, as shown in FIGS. 1A and 1B, the polygonal display panel may include the front surface display areas FFR and SFR and the side surface display areas FSR, SSR, TSR, and FOSR, in which a width of the front surface display area FFR in the first direction FDN, a width of the front surface display area SFR in the first direction FDN, and a width of each of the side surface display areas FSR and SSR in the first direction FDN may be different from each other. Therefore, a length of each of horizontal lines disposed in the front surface display area FFR, a length of each of horizontal lines disposed in the front surface display area SFR, and a length of each of horizontal lines disposed in the side surface display areas FSR and SSR may be different from each other. Accordingly, an RC delay of the front surface display area FFR, an RC delay of the front surface display area SFR, and an RC delay of each of the side surface display areas FSR and SSR, which may be generated when a scan signal or an emission signal is transmitted through the horizontal lines, may also be different from each other. As a result, non-uniformity luminance among the display areas may be caused by the difference in the RC delays. However, since the side surface display areas TSR and FOSR share horizontal lines with the front surface display area SFR, the luminance non-uniformity among the display areas due to the difference in the RC delays may be exhibited substantially in a second direction SDN.

In an exemplary embodiment of the present inventive concept, as shown in FIG. 2, the display panel 20 may include a first side surface display area FSR, a second side surface display area SSR, a third side surface display area TSR, a fourth side surface display area FOSR, a first front surface display area FFR, and a second front surface display area SFR. The first side surface display area FSR may be located on an upper side of the display panel 20 in the second direction SDN. The second side surface display area SSR may be located on a lower side of the display panel 20 in the second direction SDN. The third side surface display area TSR may be located on a left side of the display panel 20 in the first direction FDN. The fourth side surface display area FOSR may be located on a right side of the display panel 20 in the first direction FDN. The first front surface display area FFR may include curved edges CED in the second direction SDN, and the second front surface display area SFR might not include the curved edges CED in the second direction SDN. In this case, the third side surface display area TSR and the fourth side surface display area FOSR may share horizontal lines with the second front surface display area SFR, which is disposed between the third and fourth side surface display area TSR and FOSR. In this case, a width of each of the first and second side surface display areas FSR and SSR extending in the first direction FDN may be smaller than a width of the first, front surface display area FFR extending in the first direction FDN. In addition, the width of the first front surface display area FFR extending in the first direction FDN may be smaller than a width of the second front surface display area SFR extending in the first direction FDN, and the width of the first front surface display area FFR extending in the first direction FDN may gradually increase toward the second front surface display area SFR. Therefore, a length of each of horizontal lines in the first and second side surface display areas FSR and SSR may be smaller than a length of each of horizontal lines in the first front surface display area FFR. Further, the length of each of the horizontal lines in the first front surface display area FFR may be smaller than a length of each of horizontal lines in the second front surface display area SFR, and the length of each of the horizontal lines in the first front surface display area FFR may gradually increase toward the second front surface display area SFR. As a result, an RC delay of the first front surface display area FFR, an RC delay of the second front surface display area SFR, and an RC delay of each of the first and second side surface display areas FSR and SSR may be different from each other, so that the non-uniformity luminance may occur among the above display areas even if the same data signal is applied.

In an exemplary embodiment of the present inventive concept, as shown in FIG. 3, the display panel 30 may include a first side surface display area FSR, a second side surface display area SSR, a first front surface display area FFR, and a second front surface display area SFR. The first side surface display area FSR may be located on an upper side of the display panel 30 in the second direction SDN. The second side surface display area SSR may be located on a lower side of the display panel 30 in the second direction SDN. The first front surface display area FFR may include curved edges CED in the second direction SDN, and a second front surface display area SFR might not include the curved edges CED in the second direction SDN. In this case, a width of each of the first and second side surface display areas FSR and SSR in the first direction FDN may be smaller than a width of the first front surface display area FFR in the first direction FDN. Further, the width of the first front surface display area FFR in the first direction FDN may be smaller than a width of the second front surface display area SFR in the first direction FDN, and the width of the first front surface display area FFR in the first direction FDN may gradually increase toward the second front surface display area SFR. Therefore, a length of each of horizontal lines in the first and second side surface display areas FSR and SSR may be smaller than a length of each of horizontal lines in the first front surface display area FFR. Further, the length of each of the horizontal lines in the first front surface display area FFR may be smaller than a length of each of horizontal lines in the second front surface display area SFR, and the length of each of the horizontal lines in the first front surface display area FFR may gradually increase toward the second front surface display area SFR. As a result, an RC delay of the first front surface display area FFR, an RC delay of the second front surface display area SFR, and an RC delay of each of the first and second side surface display areas FSR and SSR may be different from each other, so that the non-uniformity luminance may occur among the above display areas even if the same data signal is applied.

To prevent the non-uniformity luminance, according to an exemplary embodiment of the present inventive concept, a horizontal line driver (e.g., a scan driver or an emission driver) may have a structure including an output buffer having the largest size at a position corresponding to the front surface display area SFR in which each of the horizontal lines (e.g., the scan lines or the emission lines) has the longest length (i.e., the largest RC delay). The horizontal line driver may also have a structure including an output buffer having the smallest size at positions corresponding to the side surface display areas FSR and SSR in which each of the horizontal lines has the shortest length (i.e., the smallest RC delay), and including an output buffer having a size that gradually increases toward the front surface display area SFR (e.g., having a size that gradually decreases toward the side surface display areas FSR and SSR) at a position corresponding to the front surface display area FFR in which each of the horizontal lines has a length shorter than the length of each of the horizontal lines in the front surface display area SFR and has a length longer than the length of each of the horizontal lines in the side surface display areas FSR and SSR (i.e., an RC delay smaller than the RC delay of the front surface display area SFR and larger than the RC delay of each of the side surface display areas FSR and SSR). The above configuration will be described in detail below with reference to FIGS. 4 to 9. In addition, as described above, since the side surface display areas TSR and FOSR share horizontal lines with the front surface display area SFR, the non-uniformity luminance among the display areas due to the difference in the RC delays may be exhibited substantially in the second direction SDN, so that the horizontal line driver (e.g., the scan driver or the emission driver) according to an exemplary embodiment of the present inventive concept will be described based on the display panel 30 shown in FIG. 3.

Figure 4:
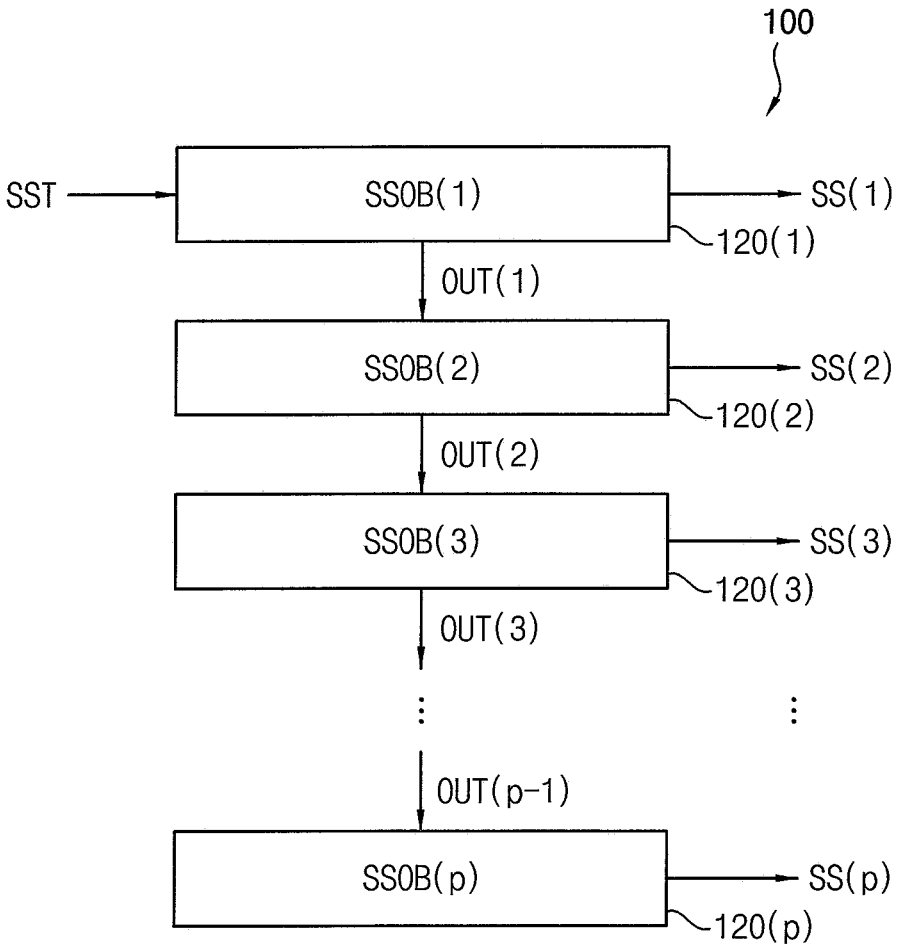
FIG. 4 is a block diagram illustrating a horizontal line driver according to an exemplary embodiment of the present inventive concept.
Figure 5:
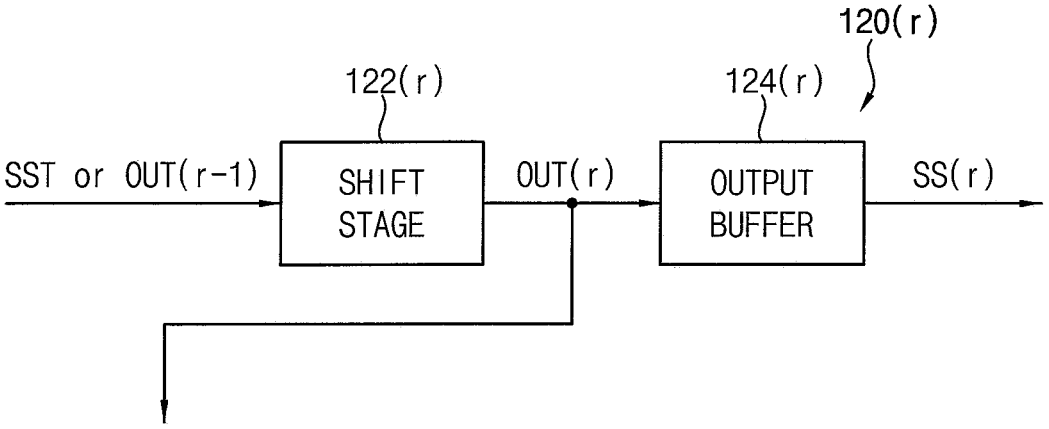
FIG. 5 is a block diagram illustrating each of scan signal output blocks included in the horizontal line driver of FIG. 4.

FIG. 4 is a block diagram illustrating a horizontal line driver according to an exemplary embodiment of the present inventive concept. FIG. 5 is a block diagram illustrating each of scan signal output blocks included in the horizontal line driver of FIG. 4, and FIG. 6 is a diagram illustrating scan signal output blocks included in the horizontal line driver of FIG. 4 connected to scan lines, respectively.

Figure 6:
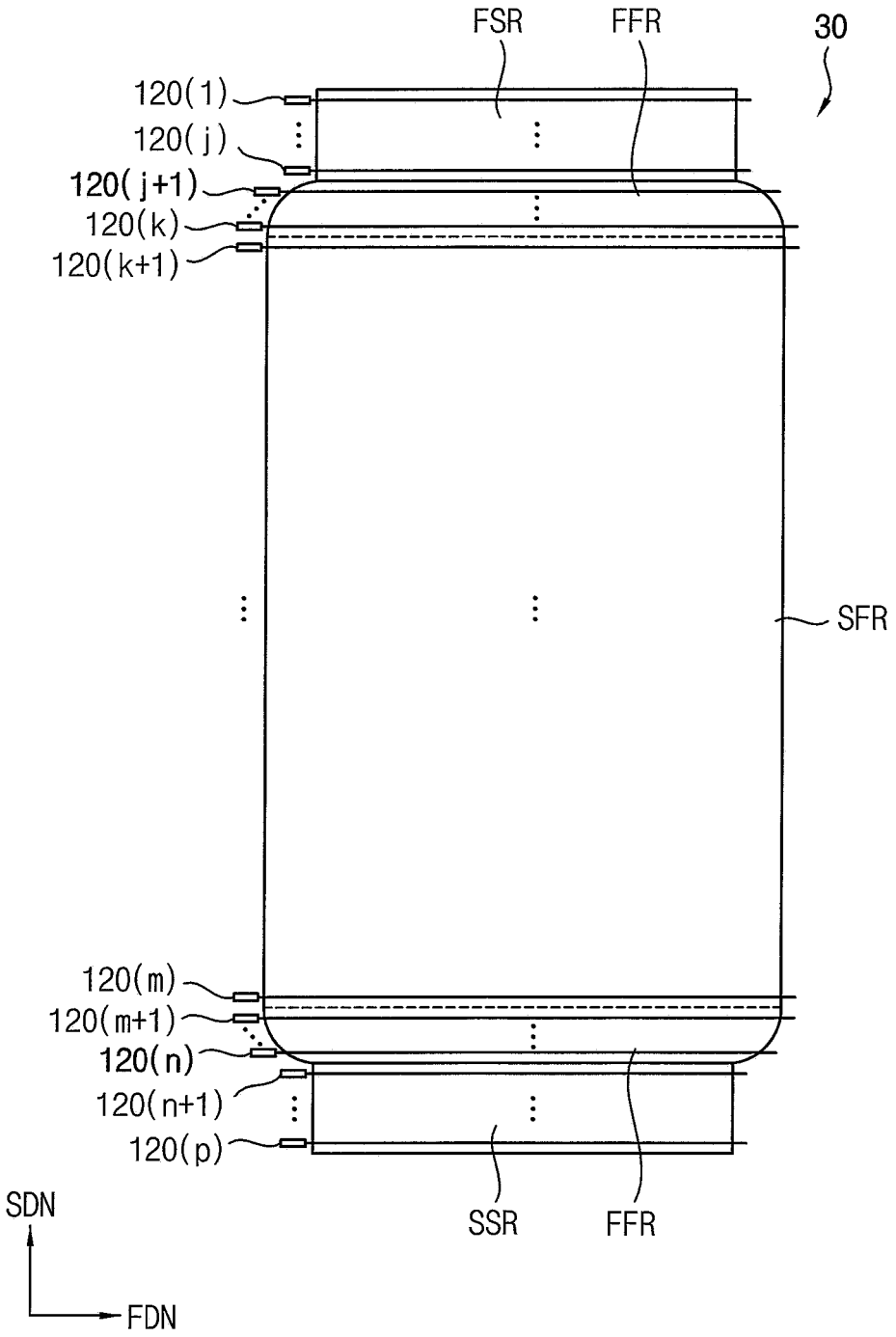
FIG. 6 is a diagram illustrating scan signal output blocks included in the horizontal line driver of FIG. 4 connected to scan lines, respectively.

Referring to FIGS. 4 to 6, a horizontal line driver 100 may provide scan signals SS(1) to SS(p) to a display panel 30 including pixel circuits connected to first to $p^{th}$ scan lines extending in a first direction FDN. For example, the horizontal line driver 100 may be a scan driver included in a display device. The horizontal line driver 100 may include first to $p^{th}$ scan signal output blocks 120(1) to 120(*p*). In this case, the horizontal line driver 100 may extend along an outer periphery of the display panel 30, so that the first to $p^{th}$ scan signal output, blocks 120(1) to 120(*p*) may be, for example, disposed along one side of the display panel 30. For example, FIG. 6 shows that the first to $p^{th}$ scan signal output blocks 120(1) to 120(*p*) are disposed along a left side of the display panel 30. However, the present inventive concept is not limited thereto, and the first to $p^{th}$ scan signal output blocks 120(1) to 120(*p*) may be disposed along multiple sides of the display panel 30. For example, the first to $p^{th}$ scan signal output blocks 120(1) to 120(*p*) may respectively provide the scan signals SS(1) to SS(p) to the first to $p^{th}$ scan lines extending in the first, direction FDN within the display panel 30. For example, the first scan signal output block 120(1) may provide the scan signal SS(1) to the first scan line, and the second scan signal output block 120(2) may provide the scan, signal SS(2) to the second scan line. In addition, the $p^{th}$ scan signal output block 120(*p*) may provide the scan signal SS(p) to the $p^{th}$ scan line.

In an exemplary embodiment of the present inventive concept, as shown in FIG. 5, a scan signal output block 120(*r*) may include a shift stage 122(*r*) and an output buffer 124(*r*). The shift stage 122(*r*) may receive a scan start signal SST or a previous output signal OUT(r−1) to output an output signal OUT(r). For example, the shift stage 122(1) included in the first scan signal output block 120(1) may receive the scan start signal SST to output an output signal OUT(1), and the scan signal output block 120(*r*) other than the first scan signal output block 120(1) may receive the previous output signal OUT(r−1) to output the output signal OUT(r). In an exemplary embodiment of the present inventive concept, the shift stage 122(*r*) may be implemented as a flip-flop. In addition, first to $p^{th}$ shift stages 122(1) to 122(*p*) respectively included in the first to $p^{th}$ scan signal output blocks 120(1) to 120(*p*) may constitute a shift register. The output buffer 124(*r*) may receive the output signal OUT(r) to output a scan signal SS(r). For example, the output buffer 124(*r*) may improve edge (e.g., a rising edge and a falling edge) characteristics of the output signal OUT(r), and may perform level shifting on the output signal OUT(r). In addition, a speed at which the scan signal SS(r) is applied to a scan line may be determined according to a size (or a capacity) of the output buffer 124(*r*). For example, the scan line may be rapidly charged when the size of the output buffer 124(*r*) is relatively large, and the scan line may be slowly charged when the size of the output buffer 124(*r*) is relatively small. Accordingly, an RC delay of the scan signal SS(r) output from the output buffer 124(*r*) may be decreased as the size of the output buffer 124(*r*) becomes larger, and the RC delay of the scan signal SS(r) output from the output buffer 124(*r*) may be increased as the size of the output buffer 124(*r*) becomes smaller. For example, the size or the output buffer 124(*r*) may be determined by sizes of elements (e.g., transistors) included in the output buffer 124(*r*).

As shown in FIG. 6, the display panel 30 may include a first side surface display area FSR, a second side surface display area SSR, a first front surface display area FFR, and a second front surface display area SFR. The first side surface display area FSR may be located on an upper side of the display panel 30 in a second direction SDN. The second side surface display area SSR may be located on a lower side of the display panel 30 in the second direction SDN. The first front surface display area FFR may include curved edges in the second direction SDN, and the second front surface display area SFR might not include the curved edges in the second direction SDN. In this case, first to $j^{th}$ scan signal output blocks 120(1) to 120(*j*) may be disposed on the one side (e.g., a left side of the first side surface display area FSR in FIG. 6) of the display panel 30 in the first direction FDN, may be configured to respectively provide scan signals SS(1) to SS(j) to first to $j^{th}$ scan lines in the first side surface display area FSR, and may include first output buffers 124(1) to 124(*j*), respectively. In addition, $(j+1)^{th}$ to $k^{th}$ scan signal output blocks 120(*j*+1) to 120(*k*) may be disposed on the one side (e.g., a left side of the first front surface display area FFR in FIG. 6) of the display panel 30 in the first direction FDN, may be configured, to respectively provide scan signals SS(j+1) to SS(k) to $(j+1)^{th}$ to $k^{th}$ scan lines in the first front surface display area FFR, and may include second output buffers 124(*j*+1) to 124(*k*), respectively. Further, $(k+1)^{th}$ to $m^{th}$ scan signal output blocks 120(*k*+1) to 120(*m*) may be disposed on the one side (e.g., a left side of the second front, surface display area SFR in FIG. 6) of the display panel 30 in the first direction FDN, may be configured to respectively provide scan signals SS(k+1) to SS(m) to $(k+1)^{th}$ to $m^{th}$ scan lines in the second front surface display area SFR, and may include third output buffers 124(*k*+1) to 124(*m*), respectively.

In addition, $(m+1)^{th}$ to $n^{th}$ scan signal output blocks 120(*m*+1) to 120(*n*) may be disposed on the one side (e.g., a left side of the first front surface display area FFR in FIG. 6) of the display panel 30 in the first direction FDN, may be configured to respectively provide scan signals SS(m+1) to SS(n) to $(m+1)^{th}$ to $n^{th}$ scan lines in the first front surface display area FFR, and may include second output buffers 124(*m*+1) to 124(*n*), respectively. Further, $(n+1)^{th}$ to $p^{th}$ scan signal output blocks 120(*n*+1) to 120(*p*) may be disposed on the one side (e.g., a left side of the second side surface display area SSR in FIG. 6) of the display panel 30 in the first direction FDN, may be configured to respectively provide scan signals SS(n+1) to SS(p) to $(n+1)^{th}$ to $p^{th}$ scan lines in the second side surface display area SSR, and may include first output buffers 124(*n*+1) to 124(*p*), respectively. In this case, a width of each of the first and second side surface display areas FSR and SSR in the first direction FDN may be smaller than a width of the first front surface display area FFR in the first direction FDN. In addition, the width of the first front surface display area FFR in the first direction FDN may be smaller than a width of the second front surface display area SFR in the first direction FDN, and the width of the first front surface display area FFR in the first direction FDN may gradually increase toward the second front surface display area SFR. Therefore, a length of each of the first to $j^{th}$ scan lines and the $(n+1)^{th}$ to $p^{th}$ scan lines may be shorter than a length of each of the $(j+1)^{th}$ to $k^{th}$ scan lines and the $(m+1)^{th}$ to $n^{th}$ scan lines. In addition, the length of each of the $(j+1)^{th}$ to $k^{th}$ scan lines and the $(m+1)^{th}$ to $n^{th}$ scan lines may be shorter than a length of each of the $(k+1)^{th}$ to $m^{th}$ scan lines, and the length of each of the $(j+1)^{th}$ to $k^{th}$ scan lines and the $(m+1)^{th}$ to $n^{th}$ scan lines may gradually increase toward the second front surface display area SFR.

Accordingly, the horizontal line driver 100 may be configured such that a size (e.g., about 104 um) of each of the first output buffers 124(1) to 124(*j*) included in the first, to $j^{th}$ scan signal output blocks 120(1) to 120(*j*) and each of the first output buffers 124(*n*+1) to 124(*p*) included in the $(n+1)^{th}$ to $p^{th}$ scan signal output blocks 120(*n*+1) to 120(*p*) may be smaller than a size (e.g., about 106 um to about 116 um) of each of the second output buffers 124(*j*+1) to 124(*k*) and 124(*m*+1) to 124(*n*) included in the $(j+1)^{th}$ to $k^{th}$ scan signal output blocks 120(*j*+1) to 120(*k*) and the $(m+1)^{th}$ to $n^{th}$ scan signal output, blocks 120(*m*+1) to 120(*n*). In addition, the horizontal line driver 100 may be configured such that the size of each of the second output buffers 124(*j*+1) to 124(*k*) and 124(*m*+1) to 124(*n*) included in the $(j+1)^{th}$ to $k^{th}$ scan signal output blocks 120(*j*+1) to 120(*k*) and the $(m+1)^{th}$ to $n^{th}$ scan signal output blocks 120(*m*+1) to 120(*n*) may be smaller than a size (e.g., about 118 um) of each of the third output buffers 124(*k*+1) to 124(*m*) included in the $(k+1)^{th}$ to $m^{th}$ scan signal output blocks 120(*k*+1) to 120(*m*). Further, the horizontal line driver 100 may also be configured such that the size of each of the second output buffers 124(*j*+1) to 124(*k*) and 124(*m*+1) to 124(*n*) included in the $(j+1)^{th}$ to $k^{th}$ scan signal output blocks 120(*j*+1) to 120(*k*) and the $(m+1)^{th}$ to $n^{th}$ scan signal output blocks 120(*m*+1) to 120(*n*) disposed in the first front surface display area FFR may gradually increase toward the second front surface display area SFR. Thus, the luminance non-uniformity due to the difference in the RC delays among the first and second side surface display areas FSR and SSR, the first front surface display area FFR, and the second front surface display area SFR can be prevented.

As described above, when driving the display panel 30 divided into the first side surface display area FSR located on the upper side in the second direction SDN (e.g., a vertical direction) substantially perpendicular to the first direction FDN (e.g., a horizontal direction), the second side surface display area SSR located on the lower side in the second direction SDN, the first front surface display area FFR including the curved edges in the second direction SDN, and the second front surface display area SFR that does not include the curved edges in the second direction SDN (wherein the width of each of the first, and second side surface display areas FSR and SSR in the first direction FDN may be smaller than the width of the first front surface display area FFR in the first direction FDN, the width of the first, front surface display area FFR in the first direction FDN may be smaller than the width of the second front surface display area SFR in the first direction FDN, and the width of the first front surface display area FFR in the first direction FDN may gradually increase toward the second front surface display area SFR), the horizontal line driver 100 (e.g., the scan driver) may have a structure including an output buffer (e.g., the third output buffers (124($k$+1) to 124($m$)) having the largest size at a position corresponding to the second front surface display area SFR, an output buffer (e.g., the first output buffers 124(1) to 124($j$) and 124($n$+1) to 124($p$)) having the smallest size at positions corresponding to the first and second side surface display areas FSR and SSR, and an output buffer (e.g., the second output buffers 124($j$+1) to 124($k$) and 124($m$+1) to 124($n$)) having a size that gradually increases toward the second front surface display area SFR (e.g., having a size that gradually decreases toward the first and second side surface display areas FSR and SSR) at a position corresponding to the first front surface display area FFR. Accordingly, the non-uniformity luminance due to the difference in the RC delays among the first and second side surface display areas FSR and SSR, the first front surface display area FFR, and the second front surface display area SFR can be prevented.

Figure 7:
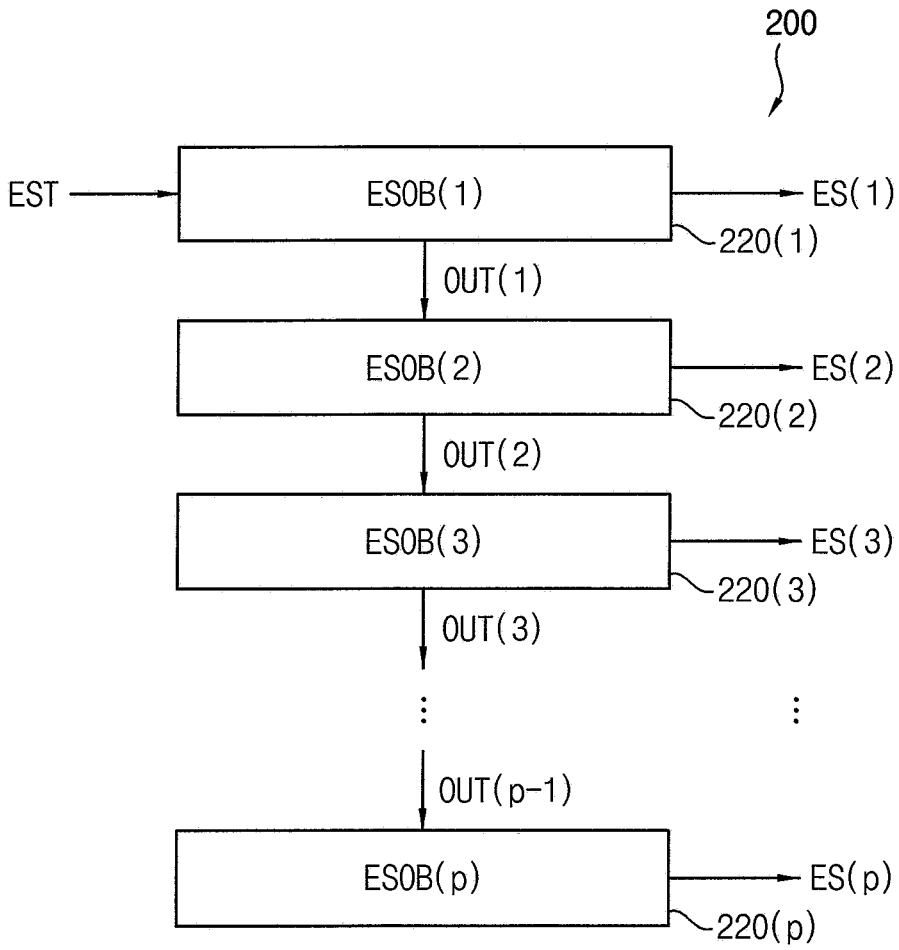
FIG. 7 is a block diagram illustrating a horizontal line driver according to an exemplary embodiment of the present inventive concept.
Figure 8:
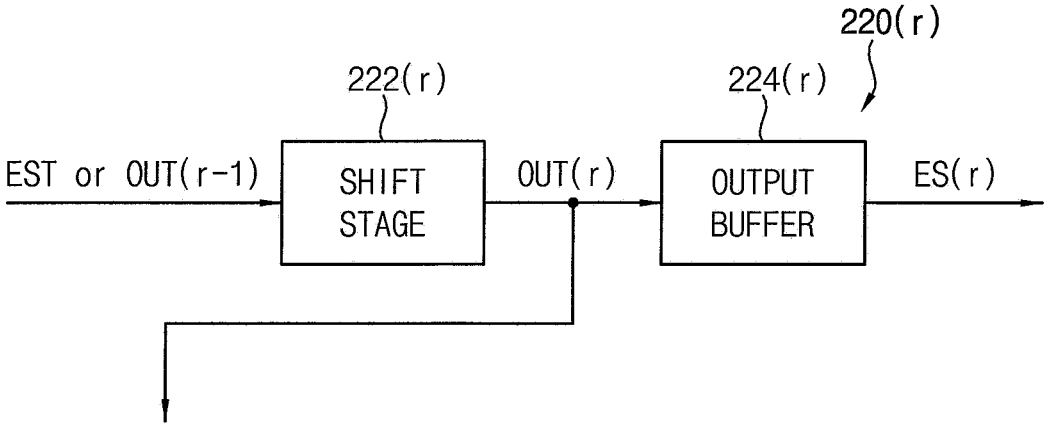
FIG. 8 is a block diagram illustrating each of emission signal output blocks included in the horizontal line driver of FIG. 7.

FIG. 7 is a block diagram illustrating a horizontal line driver according to an exemplary embodiment of the present inventive concept. FIG. 8 is a block diagram illustrating each of emission signal output blocks included in the horizontal line driver of FIG. 7, and FIG. 9 is a diagram illustrating emission signal output blocks included in the horizontal line driver of FIG. 7 connected to emission lines, respectively.

Figure 9:
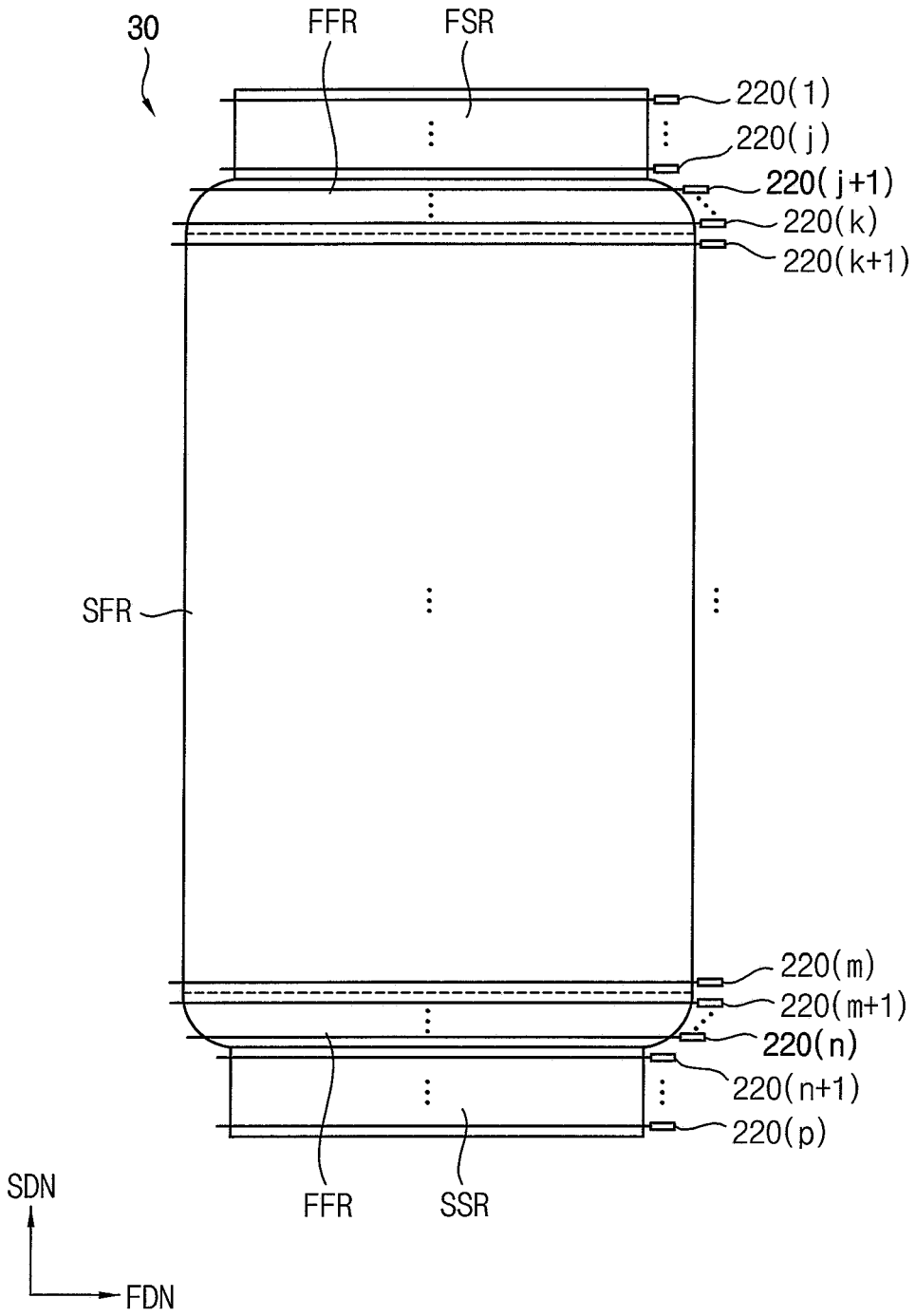
FIG. 9 is a diagram illustrating emission signal, output blocks included in the horizontal line driver of FIG. 7 connected to emission lines, respectively.

Referring to FIGS. 7 to 9, a horizontal line driver 200 may provide emission signals ES(1) to ES(p) to a display panel 30 including pixel circuits connected to first to $p^{th}$ emission lines extending in a first direction FDN. For example, the horizontal line driver 200 may be an emission driver included in a display device. The horizontal line driver 200 may include first to $p^{th}$ emission signal output blocks 220(1) to 220($p$). In this case, the horizontal line driver 200 may be designed to extend along an outer periphery of the display panel 30, so that the first to $p^{th}$ emission signal output blocks 220(1) to 220($p$) may be disposed along one side of the display panel 30. For example, FIG. 9 shows that the first to $p^{th}$ emission signal output blocks 220(1) to 220($p$) are disposed along a right side of the display panel 30. For example, the first to $p^{th}$ emission signal output blocks 220(1) to 220($p$) may respectively provide the emission signals ES(1) to ES(p) to the first to $p^{th}$ emission lines extending in the first direction FDN within the display panel 30. For example, the first emission signal output block 220(1) may provide the emission signal ES(1) to the first emission line. In addition, the second emission signal output block 220(2) may provide the emission signal ES(2) to the second emission line, and the $p^{th}$ emission signal output block 220($p$) may provide the emission signal ES(p) to the $p^{th}$ emission line.

In an exemplary embodiment of the present inventive concept, as shown in FIG. 8, an emission signal output block 220($r$) may include a shift stage 222($r$) and an output buffer 224($r$). The shift stage 222($r$) may receive an emission start signal EST or a previous output signal OUT(r−1) to output an output signal OUT(r). For example, the shift stage 222(1) included in the first emission signal output block 220(1) may receive the emission start signal EST to output an output signal OUT(1), and the emission signal output block 220($r$) other than the first emission signal output block 220(1) may receive the previous output signal OUT(r−1) to output the output signal OUT(r). In an exemplary embodiment of the present inventive concept, the shift stage 222($r$) may be implemented as a flip-flop. In addition, first to $p^{th}$ shift stages 222(1) to 222($p$) respectively included in the first to $p^{th}$ emission signal output blocks 220(1) to 220($p$) may constitute a shift register. The output buffer 224($r$) may receive the output signal OUT(r) to output an emission signal ES(r). For example, the output buffer 224($r$) may improve edge (e.g., a rising edge and a falling edge) characteristics of the output signal OUT(r), and may perform level shifting on the output signal OUT(r). In addition, a speed at which the emission signal ES(r) is applied to an emission line may be determined according to a size (or a capacity) of the output buffer 224($r$). For example, the emission line may be rapidly charged when the size of the output buffer 224($r$) is relatively large, and the emission line may be slowly charged when the size of the output buffer 224($r$) is relatively small. Accordingly, an RC delay of the emission signal ES(r) output from the output buffer 224($r$) may be decreased as the size of the output buffer 224($r$) becomes larger, and the RC delay of the emission signal ES(r) output from the output buffer 224($r$) may be increased as the size of the output buffer 224($r$) becomes smaller. For example, the size of the output buffer 224($r$) may be determined by sizes of elements (e.g., transistors) included in the output buffer 224($r$).

As shown in FIG. 9, the display panel 30 may include a first side surface display area FSR, a second side surface display area SSR, a first front surface display area FFR, and a second front surface display area SFR. The first side surface display area FSR may be located on an upper side of the display panel 30 in a second direction SDN, and the second side surface display area SSR may be located on a lower side of the display panel 30 in the second direction SDN. In addition, the first front surface display area FFR may include curved edges in the second direction SDN, and the second front surface display area SFR might not include the curved edges in the second direction SDN. In this case, first to $j^{th}$ emission signal output blocks 220(1) to 220($j$) may be disposed on the one side (e.g., a right side of the first side surface display area FSR in FIG. 9) of the display panel 30 in the first direction FDN. In addition, the first to $j^{th}$ emission signal output blocks 220(1) to 220($j$) may be configured to respectively provide emission signals ES(1) to ES(j) to first to $j^{th}$ emission lines in the first side surface display area FSR, and may include first output buffers 224(1) to 224($j$), respectively. In addition, $(j+1)^{th}$ to $k^{th}$ emission signal output blocks 220($j$+1) to 220($k$) may be disposed on the one side (e.g., a right side of the first front surface display area FFR in FIG. 9) of the display panel 30 in the first direction FDN, and may be configured to respectively provide emission signals ES(j+1) to ES(k) to $(j+1)^{th}$ to $k^{th}$ emission lines in the first front surface display area FFR. In addition, the $(j+1)^{th}$ to $k^{th}$ emission signal output blocks 220(*j*+1) to 220(*k*) may include second output buffers 224(*j*+1) to 224(*k*), respectively. Further, $(k+1)^{th}$ to $m^{th}$ emission signal output blocks 220(*k*+1) to 220(*m*) may be disposed on the one side (e.g., a right side of the second front surface display area SFR in FIG. 9) of the display panel 30 in the first direction FDN, and may be configured to respectively provide emission signals ES(k+1) to ES(m) to $(k+1)^{th}$ to $m^{th}$ emission lines in the second front surface display area SFR. In addition, the $(k+1)^{th}$ to $m^{th}$ emission signal output blocks 220(*k*+1) to 220(*m*) may include third output buffers 224(*k*+1) to 224(*m*), respectively.

In addition, $(m+1)^{th}$ to $n^{th}$ emission signal output blocks 220(*m*+1) to 220(*n*) may be disposed on the one side (e.g., a right side of the first front surface display area FFR in FIG. 9) of the display panel 30 in the first direction FDN, and may be configured to respectively provide emission signals ES(m+1) to ES(n) to $(m+1)^{th}$ to $n^{th}$ emission lines in the first front surface display area FFR. In addition, the $(m+1)^{th}$ to $n^{th}$ emission signal output blocks 220(*m*+1) to 220(*n*) may include second output buffers 224(*m*+1) to 224(*n*), respectively. Further, $(n+1)^{th}$ to $p^{th}$ emission signal output blocks 220(*n*+1) to 220(*p*) may be disposed on the one side (e.g., a right side of the second side surface display area SSR in FIG. 9) of the display panel 30 in the first direction FDN, and may be configured to respectively provide emission signals ES(n+1) to ES(p) to $(n+1)^{th}$ to $p^{th}$ emission lines in the second side surface display area SSR. In addition, $(n+1)^{th}$ to $p^{th}$ emission signal output blocks 220(*n*+1) to 220(*p*) may include first output buffers 224(*n*+1) to 224(*p*), respectively. In this case, a width of each of the first and second side surface display areas FSR and SSR in the first direction FDN may be smaller than a width of the first, front surface display area FFR in the first direction FDN. Further, the width of the first front surface display area FFR in the first direction FDN may be smaller than a width of the second front surface display area SFR in the first direction FDN, and the width of the first front surface display area FFR in the first direction FDN may gradually increase toward the second front surface display area SFR. Therefore, a length of each of the first to $j^{th}$ emission lines and the $(n+1)^{th}$ to $p^{th}$ emission lines may be shorter than a length of each of the $(j+1)^{th}$ to $k^{th}$ emission lines and the $(m+1)^{th}$ to $n^{th}$ emission lines. Further, the length of each of the $(j+1)^{th}$ to $k^{th}$ emission lines and the $(m+1)^{th}$ to $n^{th}$ emission lines may be shorter than a length of each of the $(k+1)^{th}$ to $m^{th}$ emission lines, and the length of each of the $(j+1)^{th}$ to $k^{th}$ emission lines and the (m+1) to $n^{th}$ emission lines may gradually increase toward the second front surface display area SFR.

Accordingly, the horizontal line driver 200 may be configured such that a size (e.g., about 104 um) of each of the first output buffers 224(1) to 224(*j*) included in the first to $j^{th}$ emission signal output blocks 220(1) to 220(*j*) and each of the first output buffers 224(*n*+1) to 224(*p*) included in the $(n+1)^{th}$ to $p^{th}$ emission signal output blocks 220(*n*+1) to 220(*p*) may be smaller than a size (e.g., about 106 um to about 116 um) of each of the second output buffers 224(*j*+1) to 224(*k*) and 224(*m*+1) to 224(*n*) included in the $(j+1)^{th}$ to $k^{th}$ emission signal output blocks 220(*j*+1) to 220(*k*) and the $(m+1)^{th}$ to $n^{th}$ emission signal output blocks 220(*m*+1) to 220(*n*). In addition, the horizontal line driver 200 may be configured such that the size of each of the second output buffers 224(*j*+1) to 224(*k*) and 224(*m*+1) to 224(*n*) included in the $(j+1)^{th}$ to $k^{th}$ emission signal output blocks 220(*j*+1) to 220(*k*) and the $(m+1)^{th}$ to $n^{th}$ emission signal output blocks 220(*m*+1) to 220(*n*) may be smaller than a size (e.g., about 118 um) of each of the third output buffers 224(*k*+1) to 224(*m*) included in the $(k+1)^{th}$ to $m^{th}$ emission signal output blocks 220(*k*+1) to 220(*m*). Further, the horizontal line driver 200 may also be configured such that the size of each of the second output buffers 224(*j*+1) to 224(*k*) and 224(*m*+1) to 224(*n*) included in the $(j+1)^{th}$ to $k^{th}$ emission signal output blocks 220(*j*+1) to 220(*k*) and the $(m+1)^{th}$ to $n^{th}$ emission signal output blocks 220(*m*+1) to 220(*n*) disposed in the first front surface display area FFR may gradually increase toward the second front surface display area SFR. Thus, the non-uniformity luminance due to the difference in the RC delays among the first and second side surface display areas FSR and SSR, the first front surface display area FFR, and the second front surface display area SFR can be prevented.

As described above, when driving the display panel 30 divided into the first side surface display area FSR located on the upper side in the second direction SDN, the second side surface display area SSR located on the lower side in the second direction SDN, the first front surface display area FFR including the curved edges in the second direction SDN, and the second front surface display area SFR that does not include the curved edges in the second direction SDN (wherein the width of each of the first and second side surface display areas FSR and SSR in the first direction FDN may be smaller than the width of the first front surface display area FFR in the first direction FDN, the width of the first, front surface display area FFR in the first direction FDN may be smaller than the width of the second front surface display area SFR in the first direction FDN, and the width of the first front surface display area FFR in the first direction FDN may gradually increase toward the second front surface display area SFR), the horizontal line driver 200 (e.g., the emission driver) may have a structure including an output buffer (e.g., the third output buffers (224(*k*+1) to 224(*m*)) having the largest size at a position corresponding to the second front surface display area SFR, an output buffer (e.g., the first output buffers 224(1) to 224(*j*) and 224(*n*+1) to 224(*p*)) having the smallest size at positions corresponding to the first and second side surface display areas FSR and SSR, and an output buffer (e.g., the second output buffers 224(*j*+1) to 224(*k*) and 224(*m*+1) to 224(*n*)) having a size that gradually increases toward the second front surface display area SFR (e.g., having a size that gradually decreases toward the first and second side surface display areas FSR and SSR) at a position corresponding to the first front surface display area FFR. Accordingly, the non-uniformity luminance due to the difference in the RC delays among the first and second side surface display areas FSR and SSR, the first front surface display area FFR, and the second front surface display area SFR can be prevented.

Figure 10:
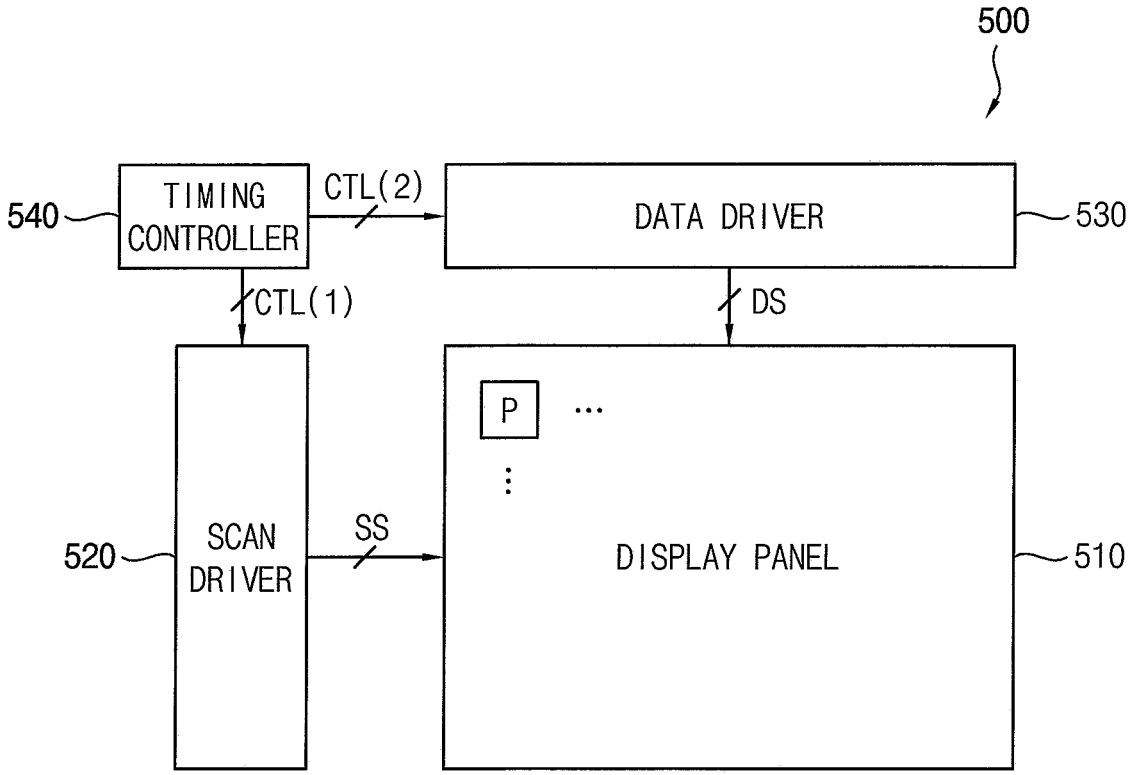
FIG. 10 is a block diagram illustrating a display device according to an exemplary embodiment of the present inventive concept.

FIG. 10 is a block diagram illustrating a display device according to an exemplary embodiment of the present inventive concept.

Referring to FIG. 10, a display device 500 may include a display panel 510, a scan driver 520, a data driver 530, and a timing controller 540. For example, the display device 500 may be an organic light emitting diode display device or a liquid crystal display device, but the display device 500 is not limited thereto.

The display panel 510 may include a plurality of pixel circuits P. In an exemplary embodiment of the present inventive concept, the pixel circuits P may be arranged in the form of a matrix within the display panel 510. The display panel 510 may include a first side surface display area, a second side surface display area, and a first front surface display area, and a second front surface display area. The first side surface display area may be located on an upper side of the display panel 510 in a second direction. The second side surface display area may be located on a lower side of the display panel 510 in the second direction. The first front surface display area may include curved edges in the second direction, and the second front surface display area might not include the curved edges in the second direction. For example, a width of each of the first and second side surface display areas in the first direction may be smaller than a width of the first front surface display area in the first direction. In addition, the width of the first front surface display area in the first direction may be smaller than a width of the second front surface display area in the first direction, and the width of the first front surface display area in the first direction may gradually increase toward the second front surface display area. However, for convenience of description, FIG. 10 shows the display panel 510 as having a rectangular shape. The display panel 510 may be connected to the scan driver 520 through scan lines extending in the first direction. Accordingly, the scan driver 520 may provide a scan signal SS to the pixel circuits P of the display panel 510 through the scan lines which are respectively connected to the pixel circuits P. In this case, a length of each of scan lines in the first and second side surface display areas may be smaller than a length of each of scan lines in the first front surface display area. In addition, the length of each of the scan lines in the first front surface display area may be smaller than a length of each of scan lines in the second front surface display area, and the length of each of the scan lines belonging to the first front surface display area may gradually increase toward the second front surface display area. The display panel 510 may be connected to the data driver 530 through data lines extending in the second direction. Accordingly, the data driver 530 may convert image data provided from the timing controller 540 into a data voltage, for example, a data signal DS, and may provide the data signal DS to the pixel circuits P of the display panel 510 through the data lines respectively connected to the pixel circuits P. The timing controller 540 may control the scan driver 520 and the data driver 530. According to an exemplary embodiment of the present inventive concept, the timing controller 540 may receive the image data from an external device to perform predetermined processing (e.g., data compensation processing, etc.) on the image data, and may provide the processed image data to the data driver 530.

As described above, the scan driver 520 may include first to $j^{th}$ scan signal output blocks, $(j+1)^{th}$ to $k^{th}$ scan signal output blocks, $(k+1)^{th}$ to $m^{th}$ scan signal output blocks, $(m+1)^{th}$ to $n^{th}$ scan signal output blocks, and $(n+1)^{th}$ to $p^{th}$ scan signal output blocks. The first to $j^{th}$ scan signal output blocks may be configured to provide a scan signal SS to first to $j^{th}$ scan lines disposed in the first side surface display area, and may be disposed on one side of the display panel 510 in the first direction. Further, each of the first to $j^{th}$ scan signal output blocks may include a first output buffer. The $(j+1)^{th}$ to $k^{th}$ scan signal output blocks may be configured to provide the scan signal SS to $(j+1)^{th}$ to $k^{th}$ scan lines disposed in the first front surface display area, and may be disposed on the one side of the display panel 510 in the first direction. Further, each of the $(j+1)^{th}$ to $k^{th}$ scan signal output blocks may include a second output buffer. The $(k+1)^{th}$ to $m^{th}$ scan signal output blocks may be configured to provide the scan signal SS to $(k+1)^{th}$ to $m^{th}$ scan lines disposed in the second front surface display area, and may be disposed on the one side of the display panel 510 in the first direction. Further, each of the $(k+1)^{th}$ to $m^{th}$ scan signal output blocks may include a third output buffer. The $(m+1)^{th}$ to $n^{th}$ scan signal output blocks may be configured to provide the scan signal SS to $(m+1)^{th}$ to $n^{th}$ scan lines disposed in the first front surface display area, and may be disposed on the one side of the display panel 510 in the first direction. Further, each of the $(k+1)^{th}$ to $m^{th}$ scan signal output blocks may include the second output buffer. The $(n+1)^{th}$ to $p^{th}$ scan signal output blocks may be configured to provide the scan signal SS to $(n+1)^{th}$ to $p^{th}$ scan lines disposed in the second side surface display area, and may be disposed on the one side of the display panel 510 in the first direction. Further, each of the $(n+1)^{th}$ to $p^{th}$ scan signal output blocks may include the first output buffer. In this case, a size of the first output buffer for the first and second side surface display areas may be smaller than a size of the second output buffer for the first front surface display area. In addition, the size of the second output buffer for the first front surface display area may be smaller than a size of the third output buffer for the second front surface display area, and the size of the second output buffer for the first front surface display area may gradually increase toward the second front surface display area. However, since the above configuration has been described with reference to FIGS. 4 to 6, redundant descriptions thereof will be omitted. Accordingly, the display device 500 includes the scan driver 520 that may prevent non-uniformity luminance due to a difference in RC delays among the first and second side surface display areas, the first front surface display area, and the second front surface display area in the display panel 510, so that high-quality images can be provided to the user.

Figure 11:
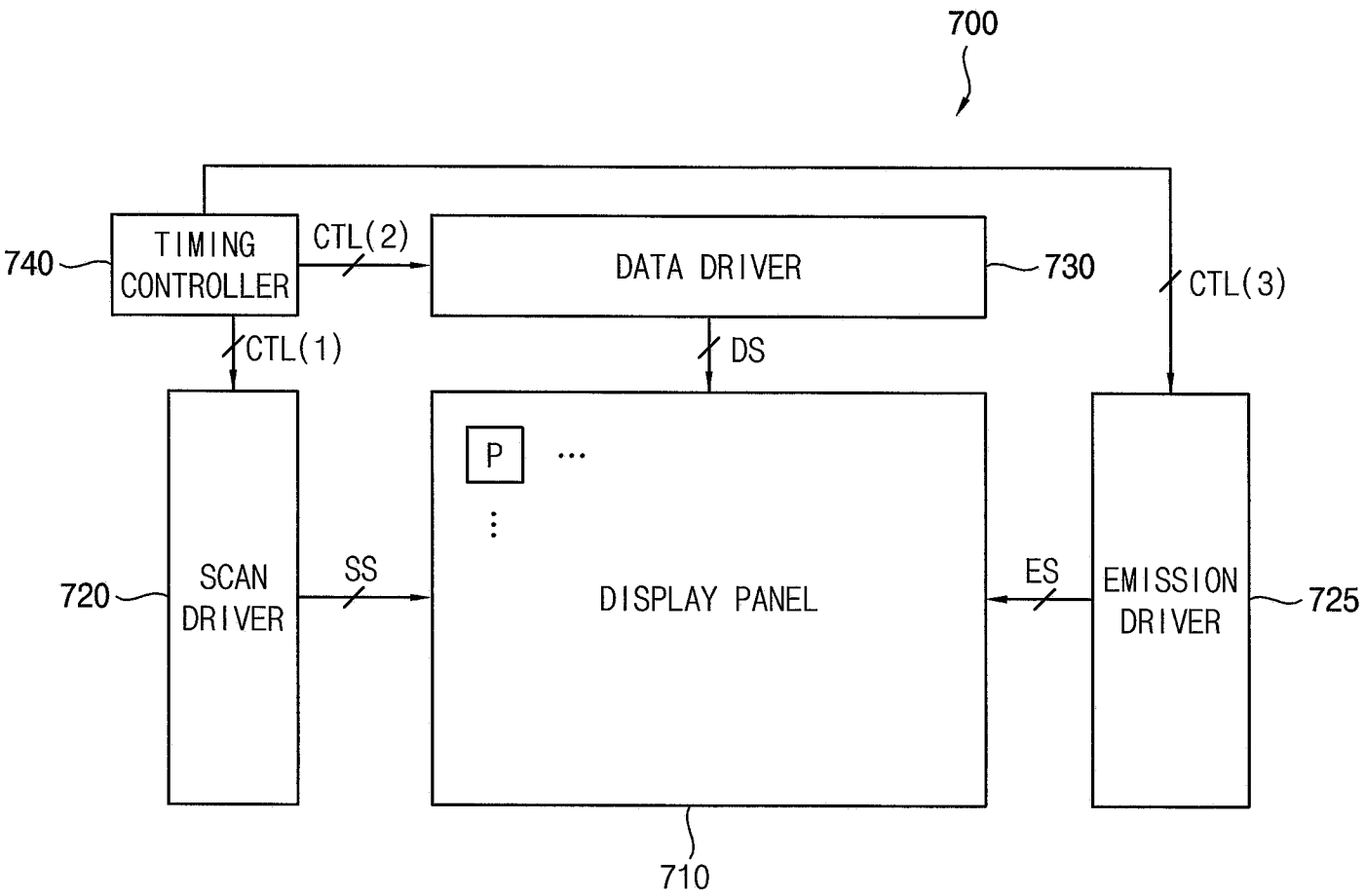
FIG. 11 is a block diagram illustrating a display device according to an exemplary embodiment of the present inventive concept.

FIG. 11 is a block diagram illustrating a display device according to an exemplary embodiment of the present inventive concept.

Referring to FIG. 11, a display device 700 may include a display panel 710, a scan driver 720, an emission driver 725, a data driver 730, and a timing controller 740. For example, the display device 700 may be an organic light emitting diode display device or a liquid crystal display device, but the display device 700 is not limited thereto. In addition, since the display device 700 of FIG. 11 is substantially the same as the display device 700 of FIG. 10 except that the display device 700 of FIG. 11 further includes the emission driver 725, the description of the display device 700 of FIG. 11 will focus on the emission driver 725.

The display panel 710 may include a plurality of pixel circuits P. In an exemplary embodiment of the present inventive concept, the pixel circuits P may be arranged in the form of a matrix within the display panel 710. The display panel 710 may include a first side surface display area, a second side surface display area, a first front surface display area, a second front surface display area. The first side surface display area may be located on an upper side of the display panel 710 in a second direction (e.g., a vertical direction) substantially perpendicular to a first direction (e.g., a horizontal direction). The second side surface display area may be located on a lower side of the display panel 710 in the second direction. The first front surface display area may include curved edges in the second direction. The second front surface display area might not include the curved edges in the second direction. For example, a width of each of the first and second side surface display areas in the first direction may be smaller than a width of the first front surface display area in the first direction, and the width of the first front surface display area in the first direction may be smaller than a width of the second front surface display area in the first direction. In addition, the width of the first front surface display area in the first direction may gradually increase toward the second front surface display area. However, for convenience of description, FIG. 11 shows the display panel 710 has a rectangular shape. The display panel 710 may be connected to the scan driver 720 through scan lines extending in the first direction. Accordingly, the scan driver 720 may respectively provide scan signals SS to the pixel circuits P of the display panel 710 through the scan lines. The display panel 710 may be connected to the emission driver 725 through emission lines extending in the first direction. Accordingly, the emission driver 725 may respectively provide emission signals ES to the pixel circuits P of the display panel 710 through the emission lines. For example, a length of each of emission lines, which extend in the first direction, disposed in the first and second side surface display areas may be smaller than a length of each of emission lines, which extend in the first direction, disposed the first front surface display area. In addition, the length of each of the emission lines disposed in the first front surface display area may be smaller than a length of each of emission lines, which extend in the first direction, disposed in the second front surface display area, and the length of each of the emission lines disposed in the first front surface display area may gradually increase toward the second front surface display area. The display panel 710 may be connected to the data driver 730 through data lines extending in the second direction. Accordingly, the data driver 730 may respectively provide the data signals DS to the pixel circuits P of the display panel 710 through the data lines. The timing controller 740 may control the scan driver 720, the emission driver 725, and the data driver 730.

As described above, the scan driver 720 may be located on one side of the display panel 710 in the first direction, and the emission driver 725 may be located on an opposite side of the display panel 710 in the first direction. For example, the emission driver 725 may include first to $j^{th}$ emission signal output blocks, $(j+1)^{th}$ to $k^{th}$ emission signal output blocks, $(k+1)^{th}$ to $m^{th}$ emission signal output blocks, $(m+1)^{th}$ to $n^{th}$ emission signal output blocks, and $(n+1)^{th}$ to $p^{th}$ emission signal output blocks. The first to $j^{th}$ emission signal output blocks may be configured to respectively provide an emission signal ES to first to $j^{th}$ emission lines disposed in the first side surface display area, and may be disposed on the opposite side of the display panel 710 in the first direction. Further, each of the first to $j^{th}$ emission signal output blocks may include a first output buffer. The $(j+1)^{th}$ to $k^{th}$ emission signal output blocks may be configured to respectively provide the emission signal ES to $(j+1)^{th}$ to $k^{th}$ emission lines disposed in the first front surface display area, and may be disposed on the opposite side of the display panel 710 in the first direction. In addition, each of the $(j+1)^{th}$ to $k^{th}$ emission signal output blocks may include a second output buffer. The $(k+1^{th}$ to $m^{th}$ emission signal output blocks may be configured to respectively provide the emission signal ES to $(k+1)^{th}$ to $m^{th}$ emission lines disposed in the second front surface display area, and may be disposed on the opposite side of the display panel 710 in the first direction. Further, each of the $(j+1)^{th}$ to $k^{th}$ emission signal output blocks may include a third output buffer. The $(m+1)^{th}$ to $n^{th}$ emission signal output blocks may be configured to respectively provide the emission signal ES to $(m+1)^{th}$ to $n^{th}$ emission lines disposed in the first front surface display area, and may disposed on the opposite side of the display panel 710 in the first direction. Further, each of the $(m+1)^{th}$ to $n^{th}$ emission signal output blocks may include the second output buffer. The $(n+1)^{th}$ to $p^{th}$ emission signal output blocks may be configured to respectively provide the emission signal ES to $(n+1)^{th}$ to $p^{th}$ emission lines disposed in the second side surface display area, and may be disposed on the opposite side of the display panel 710 in the first direction. Further, each of the $(n+1)^{th}$ to $p^{th}$ emission signal output blocks may include the first output buffer. In this case, a size of the first output buffer for the first and second side surface display areas may be smaller than a size of the second output buffer for the first front surface display area. In addition, the size of the second output buffer for the first front surface display area may be smaller than a size of the third output buffer for the second front surface display area, and the size of the second output buffer for the first front surface display area may gradually increase toward the second front surface display area. However, since the above configuration has been described with reference to FIGS. 7 to 9, redundant descriptions thereof will be omitted. Accordingly, the display device 700 includes the scan driver 720 and the emission driver 725 that may prevent non-uniformity luminance due to a difference in RC delays among the first and second side surface display areas, the first front surface display area, and the second front surface display area in the display panel 710, so that high-quality images can be provided to the user.

Figure 12:
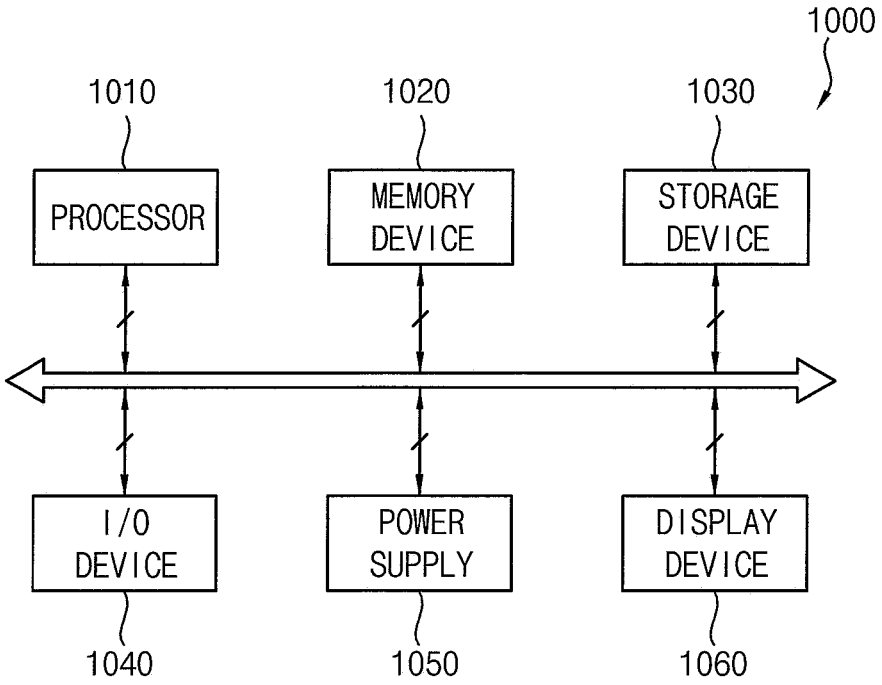
FIG. 12 is a block diagram illustrating an electronic device according to an exemplary embodiment of the present inventive concept.

FIG. 12 is a block diagram illustrating an electronic device according to an exemplary embodiment of the present inventive concept.

Referring to FIG. 12, the electronic device 1000 may include a processor 1010, a memory device 1020, a storage device 1030, an input/output (I/O) device 1040, a power supply 1050, and a display device 1060. Here, the display device 1060 may be the display device 500 of FIG. 10 or the display device 700 of FIG. 11. In addition, the electronic device 1000 may further include a plurality of ports for communicating with a video card, a sound card, a memory card, a universal serial bus (USB) device, other electronic devices, etc. In an exemplary embodiment of the present inventive concept, as illustrated in FIG. 1, the electronic device 1000 may be implemented as a smart phone. However, the electronic device 1000 is not limited thereto. For example, the electronic device 1000 may be implemented as a cellular phone, a video phone, a smart pad, a smart watch, a tablet PC, a car navigation system, a computer monitor, a laptop, a digital camera, etc.

The processor 1010 may perform various computing functions. The processor 1010 may be, for example, a micro processor, a central processing unit (CPU), an application processor (AP), etc. The processor 1010 may be coupled to other components via an address bus, a control bus, a data bus, etc. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc. and/or at least one volatile memory device such as a dynamic random access memory (DRAM) device, a static random access memory (SRAM) device, a mobile DRAM device, etc. The storage device 1030 may include a solid state drive (SSD) device, a hard disk drive (HDD) device, a CD-ROM device, etc. The I/O device 1040 may include an input device, such as a keyboard, a keypad, a mouse device, a touch-pad, a touch-screen, etc., and an output device, such as a printer, a speaker, etc. In an exemplary embodiment of the present inventive concept, the display device 1060 may be included in the I/O device 1040. The power supply 1050 may provide power for operations of the electronic device 1000.

The display device 1060 may be coupled to other components via the buses or other communication links. Here, the display device 1060 may be, for example, an organic light emitting display device or a liquid crystal display device. However, the display device 1060 is not limited thereto. In an exemplary embodiment of the present inventive concept, the display device 1060 may include a display panel including a plurality of pixel circuits, a scan driver that provides a scan signal to the display panel through scan lines extending in a first direction (e.g., a horizontal direction), a data driver that provides a data signal to the display panel through data lines extending in a second direction (e.g., a vertical direction) substantially perpendicular to the first direction, and a timing controller that controls the scan driver and the data driver. In an exemplary embodiment of the present inventive concept, the display device 1060 may include a display panel including a plurality of pixel circuits, a scan driver that provides a scan signal to the display panel through scan lines extending in a first direction, an emission driver that provides an emission signal to the display panel through emission lines extending in the first direction, a data driver that provides a data signal to the display panel through data lines extending in a second direction substantially perpendicular to the first direction, and a timing controller that controls the scan driver, the emission driver, and the data driver. Here, according to an exemplary embodiment of the present inventive concept, the display panel may be divided into a first side surface display area located on an upper side in the second direction, a second side surface display area located on a lower side in the second direction, a first front surface display area including curved edges in the second direction, and a second front surface display area that does not include the curved edges in the second direction (wherein a width of each of the first and second side surface display areas in the first direction is smaller than a width of the first front surface display area in the first direction, the width of the first front surface display area in the first direction is smaller than a width of the second front surface display area in the first direction, and the width of the first front surface display area in the first direction gradually increases toward the second front surface display area). In addition, a horizontal line driver (e.g., the scan driver or the emission driver) may have a structure including an output buffer having the largest size (or a capacity) at a position corresponding to the second front surface display area, and an output buffer having the smallest size at positions corresponding to the first and second side surface display areas. In addition, the structure of the horizontal line driver may include an output buffer having a size that gradually increases toward the second front surface display area at a position corresponding to the first front surface display area. As a result, the horizontal line driver may prevent non-uniformity luminance due to a difference in RC delays among the first and second side surface display areas, the first front surface display area, and the second front surface display area, and thus the display device 1060 may provide a high-quality image to a viewer (or user). Since these are described above, duplicated description related thereto will not be repeated.

The present inventive concept may be applied to a display device and an electronic device including the display device. For example, the present inventive concept may be applied to a smart phone, a cellular phone, a video phone, a smart pad, a smart watch, a tablet personal computer (PC), a car navigation system, a computer monitor, a laptop, a digital camera, etc.

While the present inventive concept has been described with reference to exemplary embodiments thereof, it will be understood by those of ordinary skill in the art that various changes in form and details may be made thereto without departing from the spirit and scope of the present inventive concept.

What is claimed is:

1. A horizontal line driver configured to provide a scan signal to a display panel including a plurality of pixel circuits respectively connected to scan lines extending in a first direction, the horizontal line driver comprising:

first to $j^{th}$ scan signal output blocks configured to respectively provide the scan signal to first to $j^{th}$ scan lines disposed in a first side surface display area located on a first side of the display panel extending in the first direction, wherein the first to $j^{th}$ scan signal output blocks are disposed on a second side of the display panel extending in a second direction substantially perpendicular to the first direction, wherein each of the first to $j^{th}$ scan signal output blocks include a first output buffer, and wherein j is an integer greater than 1;

$(j+1)^{th}$ to $k^{th}$ scan signal output blocks configured to respectively provide the scan signal to $(j+1)^{th}$ to $k^{th}$ scan lines disposed in a first front surface display area including curved edges extending in the second direction, wherein the $(j+1)^{th}$ to $k^{th}$ scan signal output blocks are disposed on the second side of the display panel, wherein each of the $(j+1)^{th}$ to $k^{th}$ scan signal output blocks include a second output buffer, and wherein k is an integer greater than j+1; and $(k+1)^{th}$ to $m^{th}$ scan signal output blocks configured to respectively provide the scan signal to $(k+1)^{th}$ to $m^{th}$ scan lines disposed in a second front surface display area, wherein the $(k+1)^{th}$ to $m^{th}$ scan signal output blocks are disposed on the second side of the display panel, wherein each of the $(k+1)^{th}$ to $m^{th}$ scan signal output blocks include a third output buffer, and wherein m is an integer greater than k+1, wherein a width of the first side surface display area in the first direction is smaller than a width of the first front surface display area in the first direction, wherein the width of the first front surface display area is smaller than a width of the second front surface display area in the first direction, and wherein the width of the first front surface display area gradually increases toward the second front surface display area.

2. The horizontal line driver of claim 1, wherein a length of each of the first to $j^{th}$ scan lines is shorter than a length of each of the $(j+1)^{th}$ to $k^{th}$ scan lines, wherein the length of each of the $(j+1)^{th}$ to $k^{th}$ scan lines is shorter than a length of each of the $(k+1)^{th}$ to $m^{th}$ scan lines, and wherein the length of each of the $(j+1)^{th}$ to $k^{th}$ scan lines gradually increases toward the second front surface display area.

3. The horizontal line driver of claim 2, wherein a size of the first output buffer is smaller than a size of the second output buffer, wherein the size of the second output buffer is smaller than a size of the third output buffer, and wherein the size of the second output buffer gradually increases toward the second front surface display area.

4. The horizontal line driver of claim 1, further comprising:

$(m+1)^{th}$ to $n^{th}$ scan signal output blocks configured to respectively provide the scan signal to $(m+1)^{th}$ to $n^{th}$ scan lines disposed in the first front surface display area, wherein $(m+1)^{th}$ to $n^{th}$ scan signal output blocks are disposed on the second side of the display panel, wherein each of the $(m+1)^{th}$ to $n^{th}$ scan signal output blocks include the second output buffer, and wherein n is an integer greater than m+1; and $(n+1)^{th}$ to $p^{th}$ scan signal output blocks configured to respectively provide the scan signal to $(n+1)^{th}$ to $p^{th}$ scan lines disposed in a second side surface display area located on a third side of the display panel extending in the first direction, wherein the $(n+1)^{th}$ to $p^{th}$ scan signal output blocks are disposed on the second side of the display panel, wherein each of the $(n+1)^{th}$ to $p^{th}$ scan signal output blocks include the first output buffer, and wherein p is an integer greater than n+1, wherein a width of the second side surface display area in the first direction is smaller than the width of the first front surface display area in the first direction.

5. The horizontal line driver of claim 4, wherein a length of each of the $(n+1)^{th}$ to $p^{th}$ scan lines is shorter than a length of each of the $(m+1)^{th}$ to $n^{th}$ scan lines, wherein the length of each of the $(m+1)^{th}$ to $n^{th}$ scan lines is shorter than a length of each of the $(k+1)^{th}$ to $m^{th}$ scan lines, and wherein the length of each of the $(m+1)^{th}$ to $n^{th}$ scan lines gradually increases toward the second front surface display area.

6. The horizontal line driver of claim 5, wherein a size of the first output buffer is smaller than a size of the second output buffer, wherein the size of the second output buffer is smaller than a size of the third output buffer, and wherein the size of the second output buffer gradually increases toward the second front surface display area.

7. A horizontal line driver configured to provide an emission signal to a display panel including a plurality of pixel circuits respectively connected to emission lines extending in a first direction, the horizontal line driver comprising:

first to $j^{th}$ emission signal output blocks configured to respectively provide the emission signal to first to $j^{th}$ emission lines disposed in a first side surface display area located on a first side of the display panel extending in the first direction, wherein the first to $j^{th}$ emission signal output blocks are disposed on a second side of the display panel extending in a second direction substantially perpendicular to the first direction, wherein each of the first to $j^{th}$ emission signal output blocks include a first output buffer, and wherein j is an integer greater than 1;

$(j+1)^{th}$ to $k^{th}$ emission signal output blocks configured to respectively provide the emission signal to $(j+1)^{th}$ to $k^{th}$ emission lines disposed in a first front surface display area including curved edges in the second direction, wherein the $(j+1)^{th}$ to $k^{th}$ emission signal output blocks are disposed on the second side of the display panel, wherein each of the $(j+1)^{th}$ to $k^{th}$ emission signal output blocks include a second output buffer, and wherein k is an integer greater than j+1; and $(k+1)^{th}$ to $m^{th}$ emission signal output blocks configured to respectively provide the emission signal to $(k+1)^{th}$ to $m^{th}$ emission lines disposed in a second front surface display area that does not include curved edges extending in the second direction, wherein the $(k+1)^{th}$ to $m^{th}$ emission signal output blocks are disposed on the second side of the display panel, wherein each of the $(k+1)^{th}$ to $m^{th}$ emission signal output blocks include a third output buffer, and wherein m is an integer greater than k+1, wherein a width of the first side surface display area in the first direction is smaller than a width of the first front surface display area in the first direction, wherein the width of the first front surface display area is smaller than a width of the second front surface display area in the first direction, and wherein the width of the first front surface display area gradually increases toward the second front surface display area.

8. The horizontal line driver of claim 7, wherein a length of each of the first to $j^{th}$ emission lines is shorter than a length of each of the $(j+1)^{th}$ to $k^{th}$ emission lines, wherein the length of each of the $(j+1)^{th}$ to $k^{th}$ emission lines is shorter than a length of each of the $(k+1)^{th}$ to $m^{th}$ emission lines, and wherein the length of each of the $(j+1)^{th}$ to $k^{th}$ emission lines gradually increases toward the second front surface display area.

9. The horizontal line driver of claim 8, wherein a size of the first output buffer is smaller than a size of the second output buffer, wherein the size of the second output buffer is smaller than a size of the third output buffer, and wherein the size of the second output buffer gradually increases toward the second front surface display area.

10. The horizontal line driver of claim 7, further comprising:

$(m+1)^{th}$ to $n^{th}$ emission signal output blocks configured to respectively provide the emission signal to $(m+1)^{th}$ to $n^{th}$ emission lines disposed in the first front surface display area, wherein the $(m+1)^{th}$ to $n^{th}$ emission signal output blocks are disposed on the second side of the display panel, wherein each of the $(m+1)^{th}$ to $n^{th}$ emission signal output blocks include the second output buffer, and wherein n is an integer greater than m+1; and $(n+1)^{th}$ to $p^{th}$ emission signal output blocks configured to respectively provide the emission signal to $(n+1)^{th}$ to $p^{th}$ emission lines disposed in a second side surface display area located on a third side of the display panel extending in the first direction, wherein the $(n+1)^{th}$ to $p^{th}$ emission signal output blocks are disposed on the second side of the display panel, wherein each of the $(n+1)^{th}$ to $p^{th}$ emission signal output blocks include the first output buffer, and wherein p is an integer greater than n+1, wherein a width of the second side surface display area in the first direction is smaller than the width of the first front surface display area in the first direction.

11. The horizontal line driver of claim 10, wherein a length of each of the $(n+1)^{th}$ to $p^{th}$ emission lines is shorter than a length of each of the $(m+1)^{th}$ to $n^{th}$ emission lines, wherein the length of each of the $(m+1)^{th}$ to $n^{th}$ emission lines is shorter than a length of each of the $(k+1)^{th}$ to $m^{th}$ emission lines, and wherein the length of each of the $(m+1)^{th}$ to $n^{th}$ emission lines gradually increases toward the second front surface display area.

12. The horizontal line driver of claim 11, wherein a size of the first output buffer is smaller than a size of the second output buffer, wherein the size of the second output buffer is smaller than a size of the third output buffer, and wherein the size of the second output buffer gradually increases toward the second front surface display area.

13. A display device comprising:

a display panel including a plurality of pixel circuits;

a scan driver configured to provide a scan signal to the display panel through scan lines extending in a first direction;

a data driver configured to provide a data signal to the display panel through data lines extending in a second direction substantially perpendicular to the first direction; and a timing controller configured to control the scan driver and the data driver, wherein the scan driver includes:

first to $j^{th}$ scan signal output blocks configured to respectively provide the scan signal to first to $j^{th}$ scan lines disposed in a first side surface display area located on an upper side of the display panel extending in the first direction, wherein the first to $j^{th}$ scan signal output blocks are disposed on a first side of the display panel extending in the second direction, wherein each of the first to $j^{th}$ scan signal output blocks include a first output buffer, and wherein j is an integer greater than 1;

$(j+1)^{th}$ to $k^{th}$ scan signal output blocks configured to respectively provide the scan signal, to $(j+1)^{th}$ to $k^{th}$ scan lines disposed in a first front surface display area including curved edges extending in the second direction, wherein $(j+1)^{th}$ to $k^{th}$ scan signal output blocks are disposed on the first side of the display panel, wherein each of the $(j+1)^{th}$ to $k^{th}$ scan signal output blocks include a second output buffer, and wherein k is an integer greater than j+1;

$(k+1)^{th}$ to $m^{th}$ scan signal output blocks configured to respectively provide the scan signal to $(k+1)^{th}$ to $m^{th}$ scan lines disposed in a second front surface display area that does not include curved edges extending in the second direction, wherein the $(k+1)^{th}$ to $m^{th}$ scan signal output blocks are disposed on the first side of the display panel, wherein each of the $(k+1)^{th}$ to $m^{th}$ scan signal output blocks include a third output buffer, and wherein m is an integer greater than k+1;

$(m+1)^{th}$ to $n^{th}$ scan signal output blocks configured to respectively provide the scan signal to $(m+1)^{th}$ to $n^{th}$ scan lines disposed in the first front surface display area, wherein the $(m+1)^{th}$ to $n^{th}$ scan signal output blocks are disposed on the first side of the display panel, wherein each of the $(m+1)^{th}$ to $n^{th}$ scan signal output blocks include the second output buffer, and wherein n is an integer greater than m+1; and $(n+1)^{th}$ to $p^{th}$ scan signal output blocks configured to respectively provide the scan signal to $(n+1)^{th}$ to $p^{th}$ scan lines disposed in a second side surface display area located on a lower side of the display panel extending in the first direction, wherein $(n+1)^{th}$ to $p^{th}$ scan signal output blocks are disposed on the first side of the display panel, wherein each of the $(n+1)^{th}$ to $p^{th}$ scan signal output blocks include the first output buffer, and wherein p is an integer greater than n+1, and wherein each of a width of the first side surface display area in the first direction and a width of the second side surface display area in the first direction is smaller than a width of the first front surface display area in the first direction, wherein the width of the first front surface display area is smaller than a width of the second front surface display area in the first direction, and wherein the width of the first front surface display area gradually increases toward the second front surface display area.

14. The display device of claim 13, wherein a length of each of the first to $j^{th}$ scan lines is shorter than a length of each of the $(j+1)^{th}$ to $k^{th}$ scan lines, wherein the length of each of the $(j+1)^{th}$ to $k^{th}$ scan lines is shorter than a length of each of the $(k+1)^{th}$ to $m^{th}$ scan lines, and wherein the length of each of the $(j+1)^{th}$ to $k^{th}$ scan lines gradually increases toward the second front surface display area.

15. The display device of claim 14, wherein a length of each of the $(n+1)^{th}$ to $p^{th}$ scan lines is shorter than a length of each of the $(m+1)^{th}$ to $n^{th}$ scan lines, wherein the length of each of the $(m+1)^{th}$ to $n^{th}$ scan lines is shorter than the length of each of the $(k+1)^{th}$ to $m^{th}$ scan lines, and wherein the length of each of the $(m+1)^{th}$ to $n^{th}$ scan lines gradually increases toward the second front surface display area.

16. The display device of claim 15, wherein a size of the first output buffer is smaller than a size of the second output buffer, wherein the size of the second output buffer is smaller than a size of the third output buffer, and wherein the size of the second output buffer gradually increases toward the second front surface display area.

17. The display device of claim 13, further comprising:

an emission driver configured to provide an emission signal to the display panel through emission lines extending in the first direction, wherein the timing controller is further configured to control the emission driver, and wherein the emission driver includes:

first to $j^{th}$ emission signal output blocks configured to respectively provide the emission signal to first to $j^{th}$ emission lines disposed in the first side surface display area, wherein the first to $j^{th}$ emission signal output blocks are disposed on a second side of the display panel opposite to the first side of the display panel, and wherein each of the first to $j^{th}$ emission signal output blocks include a fourth output buffer;

$(j+1)^{th}$ to $k^{th}$ emission signal output blocks configured to respectively provide the emission, signal to $(j+1)^{th}$ to $k^{th}$ emission lines disposed in the first front surface display area, wherein the $(j+1)^{th}$ to $k^{th}$ emission signal output blocks are disposed on the second side of the display panel, and wherein each of the $(j+1)^{th}$ to $k^{th}$ emission signal output blocks include a fifth output buffer;

$(k+1)^{th}$ to $m^{th}$ emission signal output blocks configured to respectively provide the emission signal to $(k+1)^{th}$ to $m^{th}$ emission lines disposed in the second front surface display area, wherein the $(k+1)^{th}$ to $m^{th}$ emission signal output blocks are disposed on the second side of the display panel, and wherein each of the $(k+1)^{th}$ to $m^{th}$ emission signal output blocks include a sixth output buffer;

$(m+1)^{th}$ to $n^{th}$ emission signal output blocks configured to respectively provide the emission signal to $(m+1)^{th}$ to $n^{th}$ emission lines disposed in the first front surface display area, wherein the $(m+1)^{th}$ to $n^{th}$ emission signal output blocks are disposed on the second side of the display panel, and wherein each of the $(m+1)^{th}$ to $n^{th}$ emission signal output blocks include the fifth output buffer; and $(n+1)^{th}$ to $p^{th}$ emission signal output blocks configured to respectively provide the emission signal to $(n+1)^{th}$ to $p^{th}$ emission lines disposed in the second side surface display area, wherein the $(n+1)^{th}$ to $p^{th}$ emission signal output blocks are disposed on the second side of the display panel, and each of the $(n+1)^{th}$ to $p^{th}$ emission signal output blocks include the fourth output buffer.

18. The display device of claim 17, wherein a length of each of the first to $j^{th}$ emission lines is shorter than a length of each of the $(j+1)^{th}$ to $k^{th}$ emission lines, wherein the length of each of the $(j+1)^{th}$ to $k^{th}$ emission lines is shorter than a length of each of the $(k+1)^{th}$ to $m^{th}$ emission lines, and wherein the length of each of the $(j+1)^{th}$ to $k^{th}$ emission lines gradually increases toward the second front surface display area.

19. The display device of claim 18, wherein a length of each of the $(n+1)^{th}$ to $p^{th}$ emission lines is shorter than a length of each of the $(m+1)^{th}$ to $n^{th}$ emission lines, wherein the length of each of the $(m+1)^{th}$ to $n^{th}$ emission lines is shorter than the length of each of the $(k+1)^{th}$ to $m^{th}$ emission lines, and wherein the length of each of the $(m+1)^{th}$ to $n^{th}$ emission lines gradually increases toward the second front surface display area.

20. The display device of claim 19, wherein a size of the fourth output buffer is smaller than a size of the fifth output buffer, wherein the size of the fifth output buffer is smaller than a size of the sixth output buffer, and wherein the size of the fifth output buffer gradually increases toward the second front surface display area.

* * * * *